US006502285B2

(12) United States Patent
Kiely

(10) Patent No.: US 6,502,285 B2
(45) Date of Patent: Jan. 7, 2003

(54) IMMOBILIZED AND ALIGNED CLOSURE SYSTEMS

(76) Inventor: Alice Mary Kiely, 71 Stonewall Ct., Yorktown Heights, NY (US) 10598

( * ) Notice: Subject to any disclaimer, the term of this patent is extended or adjusted under 35 U.S.C. 154(b) by 0 days.

(21) Appl. No.: 09/811,282

(22) Filed: Mar. 16, 2001

(65) Prior Publication Data

US 2002/0129470 A1 Sep. 19, 2002

(51) Int. Cl.[7] ..... A44B 19/00
(52) U.S. Cl. ..... 24/433; 24/415; 24/434
(58) Field of Search ..... 24/399, 433, 434, 24/424, 418, 419, 429, 415, 575, 576, 587

(56) References Cited

U.S. PATENT DOCUMENTS

| | | | | | |
|---|---|---|---|---|---|
| 4,662,036 | A | * | 5/1987 | Frohlich | 24/421 |
| 4,780,938 | A | * | 11/1988 | Ishii | 24/419 |
| 4,922,585 | A | | 5/1990 | Suzuki | |
| 4,976,120 | A | * | 12/1990 | Terada et al. | 70/312 |
| 5,152,036 | A | * | 10/1992 | Oda et al. | 24/424 |
| 5,412,849 | A | | 5/1995 | Fudaki | |
| 5,535,492 | A | * | 7/1996 | Lai et al. | 24/420 |
| 5,586,370 | A | | 12/1996 | Fudaki | |
| 5,625,928 | A | * | 5/1997 | Terada et al. | 24/421 |
| 5,632,070 | A | * | 5/1997 | Wakabayashi | 24/419 |
| 5,694,667 | A | | 12/1997 | Mizuno | |
| 5,836,058 | A | | 11/1998 | Cullum | |
| 5,898,979 | A | * | 5/1999 | Hamada | 24/418 |
| 5,901,420 | A | * | 5/1999 | Oda | 24/420 |
| 5,956,818 | A | | 9/1999 | Tsubata | |
| 5,996,188 | A | * | 12/1999 | Yaguramaki et al. | 24/418 |
| 6,026,547 | A | | 2/2000 | Kiely | |
| 6,105,214 | A | | 8/2000 | Press | |
| 6,112,376 | A | | 9/2000 | Akashi | |

FOREIGN PATENT DOCUMENTS

JP 2000-4911 A * 11/2000 ..... 24/424

OTHER PUBLICATIONS

DD—Method of Attaching a New Zipper # 467367 Jan. 4, 2000.
DD—Improvements to the Immobilized Alignment Closure System # 481791 Oct. 27, 2000.

* cited by examiner

*Primary Examiner*—Robert J. Sandy
*Assistant Examiner*—André L. Jackson

(57) ABSTRACT

An immobile and aligned closure system with nine embodiments comprises two elongated coupling elements (62, 62L) and (76, 76I), a self-locking slider (40, 42, 42S, 42D), a socket member (50), and a male interlocking plug member (60, 60D, 61, 84). A locking member on the slider aligns and arrests the movement of the slider, so as to couple the closure system dependably, traditionally or laterally, without movement in the slider. Embodiments include a dead person's locking pull tab (42L, 43L), a locking tab holder (44), a locking pull tab (40T), additional molding (40M, 40E 42M), locking flanges (42R, 42F, 42), and a releasable, interlocking rigid buckle for instantly coupling the closure system. Safety features, separable and non-separable applications, weather resistant zippers, two-way zippers, double zippers, hidden zippers, reversible zippers, coiled and profile zippers, magnetically coupled zippers, disposable zippers, a zipper having a minimum of components, a spring-lock assembly, and a easy method of installing immobile and aligned closure systems are also disclosed.

23 Claims, 15 Drawing Sheets

IMMOBILIZED AND ALIGNED CLOSURE SYSTEMS

BACKGROUND—FIELD OF THE INVENTION

This invention relates to zippers, particularly to an immobile and aligned closure system for providing dependably coupled slide fasteners.

BACKGROUND—DESCRIPTION OF PRIOR ART

My U.S. Pat. No. 6,026,547 (2000) entitled Immobilized Alignment Closure System, uses a plurality of arresting members situated on one of two elongated coupling elements to arrest the movement of the members and align the entrances of the members for instant, snap-lock and easy traditional coupling of the zipper. While efficacious, this system is not as easy to sew onto an object, such as a garment, as would be desirable. An alternative method of providing an immobilized and aligned socket for instant coupling is disclosed, using a single arresting member, a self-locking slider.

U.S. Pat. No. 5,694,667 to Mizuno (1997) shows an automatic locking slider for a slide fastener. Mizuno's locking slider is used only to prevent the slider from moving further down the elongate coupling element than desired. It is not used or anticipated to be used for arresting lateral movement of the slider, or for providing easy, dependable coupling. It is not used to create an aligned and immobilized entrance for instant snap-lock, lateral or immobile, traditional coupling of the zipper.

Most of the present-day zippers are constructed well before they are attached to garments. Zippers are made with two elongated coupling elements that each have a "chain" of interlocking teeth to open and close the zipper, a sliding zipper head, and a socket member or a stationary pin, which is fixed to an initiating end of the two elongated coupling elements.

Sewing these zippers onto garments is generally difficult because the socket box gets in the way of the sewing machine. Even with a special zipper foot attached to a sewing machine, the presser bar (where the foot is attached) has to rise above the socket box, resulting in loss of feeding pressure to the material. Loss of pressure can cause poor feeding of the fabric, misaligned stitches, skipped stitches, and difficulty in guiding the fabric. Lost or skipped stitches result in a loosely attached elongated coupling element to the garment. This causes difficulty in drawing up the sliding zipper head. It can also cause pre-separation of the lower end of the elongated coupling element, rendering the garment useless for cold weather. Sewing over the missed stitches causes more misaligned stitches, a bulge of thread, and snagging of the zipper head.

U.S. Pat. No. 5,412,849 to Fudaki (1995) and U.S. Pat. No. 5,586,370 to Fudaki (1996) show separable bottom stop assemblies which enable the socket box to be attached after the fastener stringers are sewn to a garment, this enables easy and neat sewing without obstruction by the box.

Fudaki's separable bottom stop assemblies, however, do not facilitate the installation of a buckle-started, immobilized alignment closure system. Fudaki's separable bottom stop assemblies also are not releasable. If an error is made in the installation of the zipper, it results in the loss of that particular zipper and a waste of time it has taken for its installation, since the tapes will have already been sewn on and the members must then be removed, to repair the zipper.

U.S. Pat. No. 6,112,376 to Akashi et al. shows a separable bottom stop assembly of a concealed slide fastener. This assembly is not a releasable system, and if an error is made during manufacture, time and materials are wasted.

Being out at night adds an added element of danger to a person, especially when they are exposed to traffic of any kind, including slow moving traffic in a parking lot. Adding reflective material to one's clothing, especially to the clothing and shoes of unwary children, is of utmost importance today. Even a small amount of reflective material, such as a tiny strip or dot on the back of a sneaker, can be seen by a driver and alert them to the presence of a pedestrian, safeguarding their precious life and well being. Reflective material added to a slide fastener, unobtrusive by day, and life saving at night, can save a person's life, especially when seen from the front of a person, where reflective material is infrequently placed on garments.

U.S. Pat. No. 4,922,585 to Suzuki et al. (1990) shows a light-reflective slide fastener, with a light reflective strip bonded to a row of coupling elements. This reflective strip fits inside the moving zipper head and is bulky. The positioning of the reflective strip and the incorporated glass beads needed for reflection, can interfere with the operation of the sliding zipper head, especially if it extensively covers the interlocking teeth. This zipper cannot be instantly coupled.

U.S. Pat. No. 5,956,818 to Tsubata (1999) shows a retro-reflective filament slide fastener formed from wire rods of thermoplastic resin and retroflective layers. This zipper, however, does not couple instantly through an arrested socket and is not releasable for easy sewing.

A safety zipper that opens under a predetermined pressure is advantageous. If a child's jacket (or anyone's) is caught by the door of a school bus, part of a bicycle, or other obtrusive object, the jacket will open, resulting in less injury to the child.

U.S. Pat. No. 5,836,058 to Cullum (1998) shows a safety release zipper. It, however, it does not totally release at the bottom of the zipper to free the user of the garment in an emergency, and it is not instantly coupled with an immobile and aligned zipper, to create a safer, easily coupled zipper.

Hidden zippers are well known in the prior art. Zippers are often covered by extended folds of fabric that cover the zipper. These folds usually come from either just one side of the separable garment, or both sides that meet in the center, to hide the zipper. These folds of fabric, in addition to hiding the zipper, block wind, air and water that can penetrate the zipper, if left uncovered. If a water-repellent fabric is used, the zipper is kept even drier under the fabric.

U.S. Pat. No. 6,105,214 to Press (2000) shows a water-resistant slide fastener and process for preparing the same, where a water-resistant layer is adhered to the stringer tapes. Press, however does not solve the problem of making a buckle-started, immobile and aligned closure system that is water resistant. This zipper does not have releasable components.

Japanese Patent Number 2000-004911 to Toshinobu comprises a sliding zipper head with a locking projection. Toshinobu's locking zipper head only concerns itself with locking the two elongated coupling elements of a slide fastener and the sliding zipper head itself. Toshinobu's zipper head does not influence or expedite initial coupling of the zipper, nor is it addressed. Initial coupling of a slide fastener is a very different process than coupling elongated coupling elements along their length, or arresting movement of a sliding zipper head in portions along their lengths.

Toshinobu's zipper head does not arrest and align the members of the female side of the zipper and it does not provide an aligned and arrested coupling socket for easy initial coupling, or a guiding entrance for initial, traditional, or snap-lock lateral coupling of the zipper.

BACKGROUND—OBJECTS AND ADVANTAGES

Accordingly, several objects of the present closure system are:

(a) to use a self-locking slider to provide an immobile and aligned socket, which is, or includes a slider, so that a slide fastener can be reliably coupled without movement in the slider and for providing a slide fastener with an instant snap together, buckle, which includes a slider, to instantly couple the slide fastener.

(b) to provide easy and durable installation of my immobilized alignment closure systems, on a garment or article of manufacture, without any of the components of the zipper hindering its installation.

(c) to make the immobile and aligned closure system versatile for use in innumerable applications.

(d) to provide a closure system where the components are releasably attached to the elongated coupling element, so that they can be taken off and returned, when needed.

(e) to provide an economical method of attaching my immobile and aligned closure systems, since if a mistake is made during installation, the components can be easily removed, corrected, and returned to the elongated coupling element, rather than discarded.

(f) to make a safer, easy to close garment, or article of manufacture, by providing glow-in-the-dark and reflective material to immobile and aligned closure systems.

(g) to provide immobile and aligned closure systems with apparatus to create waterproof and wind-resistant zippers.

(h) to make a safer garment by providing immobile and aligned closure systems with a safety zipper that releases under predetermined pressure.

(i) to provide immobile and aligned closure systems with apparatus to create a hidden zipper.

Other Objects Are:

(j) to provide an immobile and aligned closure system that needs only a single member to arrest the movement of the sliding zipper head, which provides an immobile and aligned socket, for easy and dependable coupling.

(k) to provide a buckle initiated, or buckle started slide fastener that uses a single arresting member for instant, lateral snap-lock coupling of a zipper.

(l) to create a slide fastener with a dead person's brake or lock, so the slider doesn't move unintentionally and provides an immobile and aligned socket for instant, lateral, snap-lock coupling, and smooth traditional coupling of a zipper.

(m) to provide dead person's locks and other self-locking sliders for dependable coupling, and to design shapes that are aesthetic and comfortable to the fingers for smooth operation.

(n) to create a self-locking sliding zipper head that squares itself off and properly aligns itself for providing an immobile, and aligned socket for coupling.

(o) to provide a magnetically coupled, immobile, and aligned closure system.

(p) to provide an immobile and aligned closure system for "non-separable" zippers for use on jump suits, slacks, skirts, sweaters, and the like, as well as for use on "separable" zippers.

(q) to create a parallel, dual zipper design, using two immobile and aligned zippers, for instant coupling and a wider single opening, and to provide the use of a connective zipper pull for the operation of these zippers.

(r) to provide zippers that can be sold separately for home seamstresses with easy installation and safety features, which can be installed at home as well as at manufacturing sites.

(s) to provide for placement of additional holders, such as an interlocking clip that will hold an ID, keys, ornamentation, etc., on the zipper.

(t) to equip the self-locking immobile and aligned closure system with a rigid, snap-lock interlocking buckle that instantly couples the zipper, intergarment plates, strap holders, and non-encompassing molding, for easy and dependable operation of the closure system.

(u) to create a two-way zipper that has a plurality of self-locking sliding zipper heads that provide an immobile and aligned socket for the instant, snap-lock and easy traditional coupling of a two-way zipper.

(v) to provide a immobile and arrested zipper that operates dependably, without a socket member or male interlocking member.

(w) to make an self-locking immobile and aligned closure system that couples a spring-lock assembly with a non-resilient male interlocking member.

Further Objects and Advantages are:

(x) to provide a new, easy, yet familiar way to close an article of manufacture, with a rigid, snap-together, familiar buckle which is now placed on zippered clothing, and other zippered articles.

(y) to improve my immobilized alignment closure system.

(z) to provide large, rigid buckles, tabs, and tab pulls, so that a user won't have to remove their gloves to easily couple the zipper.

(aa) to provide immobile and aligned zippers that can be used on very small applications and are strong enough to handle very large applications.

SUMMARY

In accordance with the present closure system, I provide an immobile and aligned closure system that relies upon a single component to arrest the movement of the slider and provide an immobile and aligned socket, for instant and dependable coupling. In a first embodiment, a self-locking, sliding zipper head uses a dead person's lock to align itself and to preventing unintentional movement of the zipper head for dependable, snap-lock lateral, and easy traditional coupling. In a second embodiment, an immobile and aligned closure system is created using only three components, two interlocking elongated coupling elements that directly couple each other, and a self-locking slider that aligns and arrests its own movement to provide an immobile socket for dependable coupling. A third embodiment discloses a self-locking sliding zipper head that locks, using a locking tab holder to arrest its own movement. A fourth embodiment discloses a self-locking sliding zipper head that uses the locking tab holder itself, to arrest movement and to provide proper alignment for dependable coupling. A fifth embodiment discloses improvements to the system of my earlier patent and my other immobile and aligned closure systems, that include easy and economical installation of the zipper, without the hindrance of the zipper's necessary components being in the way of the installation. A sixth embodiment discloses an arrested and aligned closure system that uses a differentiated interlocking male member and operates a "non-separable" zipper, such as that used on slacks and skirts. A seventh embodiment illustrates the arrested and aligned closure system that is wind resistant and waterproof. An eighth embodiment provides a double zipper unified by a connective strap, to make an opening wider, such as that on a computer or sports bag. This embodiment also illustrates how reflective material can make an arrested and aligned closure system seen by a motorist. A ninth embodiment discloses a magnetically coupled zipper. This embodiment also shows how safety zipper teeth, paired with magnetic coupling provide an easily coupled, safety zipper that releases under predetermined pressure to totally free a wearer, to more easily avoid or lessen injury.

Other applications for the immobile and aligned closure systems, such as for operating two-way zippers, reversible zippers, profile rib and groove zippers for plastic and storage bags are disclosed. The immobile and aligned closure systems are used for both separable zippers and non-separable zippers, with both lateral and traditional coupling. Surfaces of the components, such as the buckle halves, dead person's lock, and other pull tabs can be easily coated with (or made with in parts) a smooth rubber or other "soft touch" enhancing material to make the zipper more pleasing to the user.

With the inclusion of these new features, the easily coupled, immobile, and aligned closure systems will provide the user with more versatile, dependable, economical, and safe zippers to simplify and protect their daily lives and belongings.

DRAWINGS—FIGURES

DRAWINGS—REFERENCE NUMERALS

Figure 1:
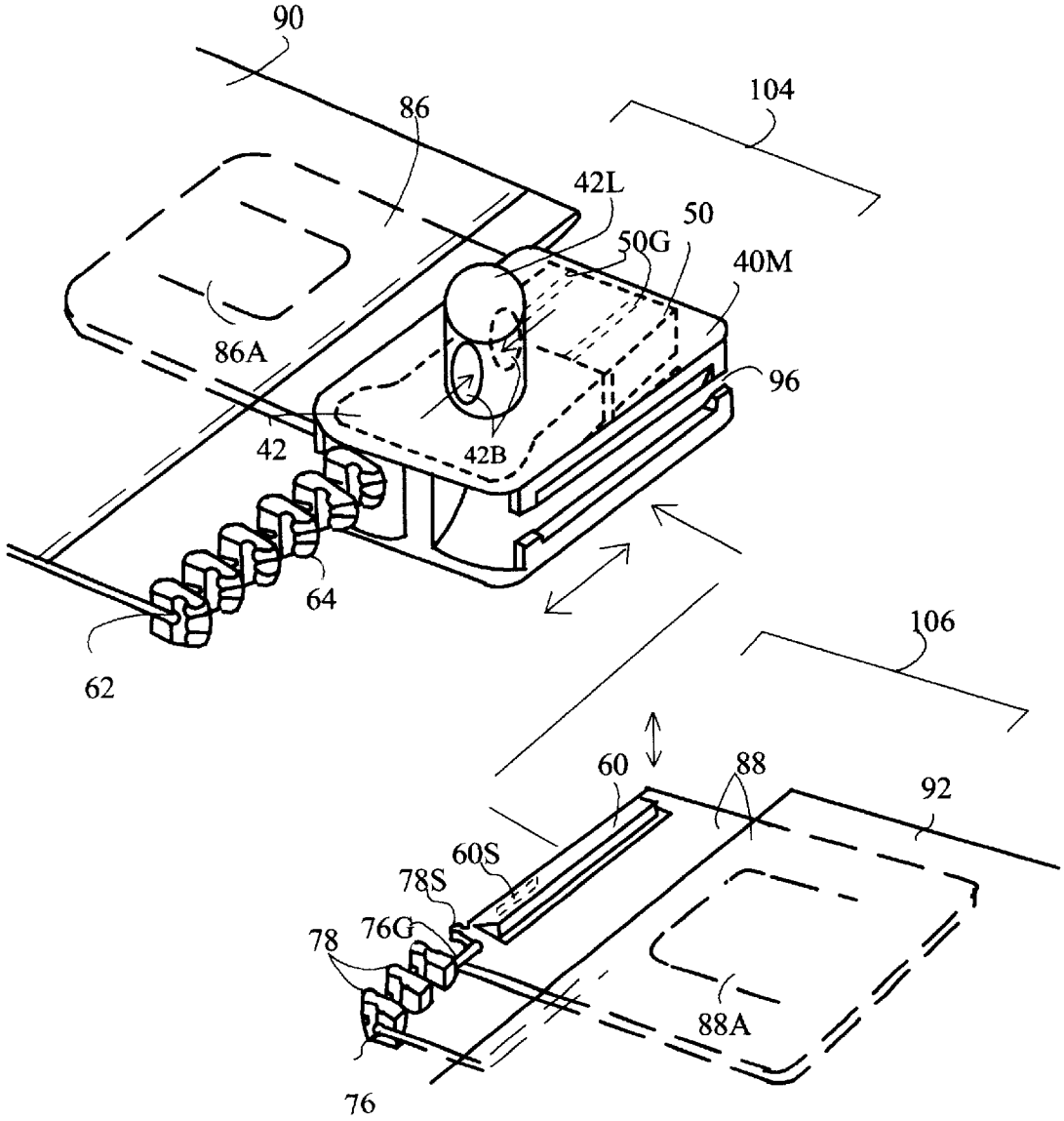
FIG. 1 is a perspective view of a first embodiment of an immobile and aligned closure system, with an automatic dead person's brake/lock.

40 self-locking slider
40D differentiated self-locking slider

40E non-encompassing molding
40L locking pull tab
40M encompassing molding
40R reflective material of 40, 62, and 76
40T zipper pull tab
40V through-hole of 40
40W uncoupling wedge
40H zipper pull-tab restraint
41 slider of an immobilized alignment closure system
41T interlocking tongue
42 dead-person's self-locking slider
42B locking buttons of 42L
42C locking member of 42L
42F lifting flanges of 42C
42L dead-person's lock/pull tab
42M encompassing molding of full length socket box
42R resilient unlocking flanges
42S slider without molding
42U spring-lock release
42V through-hole of 42
43L oval dead person's lock
43B locking buttons of 43
43H strap holder
43V through-hole of 43
44 resilient locking tab holder
44H attaching hinge(s)of tab holder
46 locking claw(s) of tab holder 44
48 locking tooth claw(s) of 40T
48A locking fabric claw of 40T
49 stationary pin
50 socket box
50D disengagement tool
50G groove
50L spring-lock mechanism
50S spring button lock
50T twin disengagement tool
50V void of socket box 50
51 spring lock socket box
51L full length socket box
51V void of socket box 51L
52 full length slider body
54 rectangular end of elongated coupling element 62
60 male interlocking member
60B release button of 60D
60D differentiated male (plug) member
60S interacting slot of coupling element 76
61 male interlocking member for use with spring-lock
61V interlocking void for 61
61W wide male interlocking member
62 $1^{st}$ elongated coupling element
62A abutment on elongated coupling element 62
62E engaging member with 60S
62I initial tooth of elongated coupling element 62
62L locking elongated coupling element
62S sewing thread
62V void in member 62
64 zipper teeth of elongated coupling element 62
64S initiating zipper tooth of coupling element 62
65 safety zipper teeth of elongated coupling element 62
65B safety zipper teeth of elongated coupling element 76
66 resilient releasing lock
68 terminal end of elongated coupling element 62
70 terminal lock of elongated coupling element 62
72 activating member of terminal lock
74 button-type releasing lock
76 $2^{nd}$ elongated coupling element
76G guiding space bar of 76
76I interlocking elongated coupling element
76B release button of 76I
76F resilient interlocking flange of 76S
76L locking edge of flange 76F
76M male interlocking member of 76I
76N socket for 76M
76S male interlocking flange member
76R guide rail
78 zipper teeth of elongated coupling element 76
78S initiating zipper tooth of coupling element 76
80 magnetic coupling force
82 sewing of elongated coupling element 62
84 magnetic male member
85 magnetic female coupling member
86 intergarment plate of elongated coupling element 62
86A thumb hold of elongated coupling element 62
86B extended housing for larger male (plug) inside 86
86E elastic/strap of 62
86H elastic/strap holder
88 intergarment plate of elongated coupling element 76
88A thumb hold of elongated coupling element 76
88E elastic/strap of 76
88H elastic/strap holder
90 fabric of element 62
90A extending fabric for hidden zipper
92 fabric of elongated coupling element 76
94 entrance of box 50
96 buckle entrance
96A slider entrance
96D differentiated entrance of slider 40
98 fabric fastener
100 connective zipper pull
102 finger
104 female half-buckle
106 male half-buckle
108 soft-touch material

DETAILED DESCRIPTION

Immobile and Aligned Closure System with Dead Person's Self-Locking Sliding Zipper Head—FIG. 1

The following illustrations are not to scale and are provided for the fundamental understanding of the disclosed closure system along with its description.

FIG. 1 is a first embodiment showing a dead-person's self-locking sliding zipper head, or slider 42, with a dead-person's-lock zipper tab 42L. This dead-person's-lock, named after the dead-man's-brake, in the railroad industry, leaves the slider in a locked position on elongated coupling element 62, until it is purposely unlocked, in order to move slider 42. The deadperson's-lock arrests all lateral (horizontal or sideways) movement—that is movement perpendicular to elongated coupling elements 62, 76, anterior-posterior, and vertical movement of slider 42, allowing slider 42 to be pushed upon laterally, for instant, audible, dependable, snap-lock lateral coupling.

Lock 42L further squares off the position of slider 42, so that its bottom end is parallel to a socket box 50. This is accomplished by inserting a locking projection, or member 42C through a through hole on the upper plate of slider 42. This inserts member 42C, between two consecutive static teeth 64 on elongated coupling element 62. Lock 42L acts both as a zipper pull tab and a lock for the slider.

Slider 42 has an encompassing molding 40M that extends beyond the edges of slider 42. Molding, depending upon the embodiment used, is extra material (material made of the sliding zipper head material or other serviceable material) around or part of the female side of the zipper. Molding is extra molded material around or extending from a traditional shaped zipper head or socket member or both, which is placed there to bring the zipper head and socket member together so it lines up the entrances together and forms a single acting non-moving and aligned entrance. This molding makes it easy for the male interlocking member to dependably couple (including lateral coupling) with the unified members of the female side of the zipper. Molding is adapted to be either encompassing molding, where a female member having extended molding outside a traditional shaped female member, may encompass another female member to provide a single acting guiding entrance, or non-encompassing molding, which unites the female members to provide a single acting entrance but the molding does not encompass another member.

Encompassing molding, depending upon the embodiment used, is also used to provide a guiding socket or a snap-lock buckle entrance 96, for instant snap-together dependable lateral buckled coupling of the two initiating ends of the zipper. Encompassing molding 40M together with socket box 50 (or other socket member) and slider 42 comprises a female half-buckle that instantly couples with a male interlocking half-buckle 106 to instantly couple the initial ends of the zipper together. The full length of the garment is then closed by slider 42. Tongues 41T on the underside of molding 40M interacts with guiding grooves 50G in the top of box 50. Coupling element 62 and teeth 64 interact immediately at the initiating end for dependable coupling. An initiating tooth 78S on coupling element 76 interengages with an initiating tooth 64S on elongated coupling element 62 (FIG. 9), and slot 60S (or similar arrangement), on coupling element 76 engages with member 62I on elongated coupling element 62, to ensure that the teeth and the initial coupling elements engage immediately and do not slip.

Figure 1A:
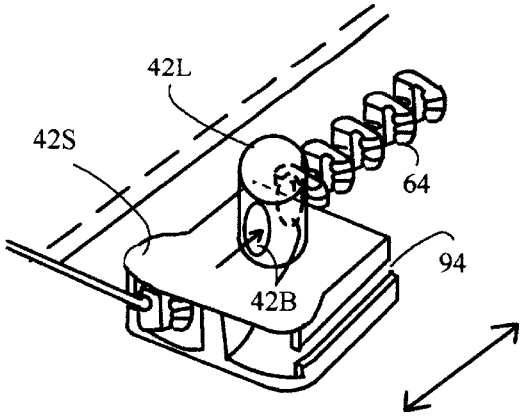
FIG. 1A is a perspective view of the first embodiment showing an automatic dead person's lock pull tab, without encompassing or non-encompassing molding.
Figure 1B:
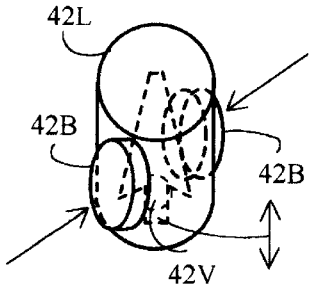
FIG. 1B is an enlarged perspective view of the pull tab of FIGS. 1 and 1A, showing the movement arresting mechanism inside.

Lock 42L is orientated on the upper surface of slider 42, above a through hole or void 42V of slider 42 (FIG. 1B). Lock 42L has two (one, or other) activating buttons 42B (or other means, such as a twisting motion to lock 42L, which can raise and lower lock 42C on the front and rear of lock 42L, not shown). Buttons 42B when simultaneously compressed, raise locking member 42C from teeth 64 and release lock 42L, allowing slider 42 to be pulled by lock 42L, along elongated coupling element 62, for opening or closing of the zipper.

Slider 42 has an encompassing molding 40M. Slider 42 can fully operate and arrest its movement without molding 40M. Lock 42L arrests all movement of slider 42 and operates in much the same way in this embodiment, as when located on a slider that does not have encompassing molding (FIG. 1A). Encompassing molding 40M adds connecting material for additional immobility and stability, since the components are located on a fabric elongated coupling element and the fabric can move. Molding 40M also provides a single outside entrance with an aesthetic appearance. A stiff intergarment plate 88 is attached to, or part of, an interlocking resilient male member 60, and is preferably located within or behind fabric 72. A corresponding intergarment plate 86 is located on elongated coupling element 62.

Encompassing molding 40M, slider 42 and box 50 (or other socket member or arrangement) form a rigid, female, half-buckle 104, as shown by the bracket, to instantly couple with male interlocking member 60 and intergarment plate 88, a rigid male, half-buckle of a snap-lock buckle, as shown by the bracket. These two rigid buckle halves, with their corresponding attached elongated coupling elements, 62 and 76, instantly snap together to initially couple the zipper. A guide 76G on intergarment plate 88 provides allowance for elongated coupling element 76 to simultaneously slide above entrance 96, while member 60 is pressed into the immobile and aligned socket or entrance 96 during coupling. This aligns and brings elongated coupling element 76 in close proximity to elongated coupling element 62 so they can be smoothly coupled along their length, by slider 42/40M. Initial zipper tooth 78S on plate 88 engages a small zipper tooth 64S on a stationary pin 49 on elongated coupling element 62 to align and mesh elements 76 and 62. Intergarment plate 86 is an optional part of half-buckle 104, because it helps provide a stiff dependable coupling, but the closure system can operate without plate 86. The user can place their fingers on half-buckle 104 instead.

FIG. 1—Operation of Immobile and Aligned Closure System with Dead Person's Self-Locking Sliding Zipper Head To operate the closure system, the user pushes buttons 42B simultaneously toward each other. When the user pushes buttons 42B together, towards the interior of lock 42L, buttons 42B compress resilient flanges 42R toward each other (FIGS. 1B–E). As a result, flanges 42R push flanges 42F in an upward direction, FIG. 1E. Locking member 42C, which is attached to flanges 42F is pulled upward. This removes locking member 42C from its locking position, between two consecutive teeth 64. The user keeps the pressure on buttons 42B while drawing slider 42 along elongated coupling element 62. When the user releases the pressure on buttons 42B, flanges 42R and 42F relax and lower member 42C to a position between two consecutive teeth 64. This automatically locks, squares and properly aligns slider 42. It also provides an immobile and aligned socket with entrance 94 for instant coupling. The front and rear edges of member 42C are slightly tapered to slide between next two teeth 64 or previous two teeth 64, if member 42C happens to come to rest directly upon the top of a singular tooth.

For normal operation of a jacket, for example, the user squeezes buttons 42B and draws slider 42 to the initiating end of elongated coupling element 62 until it can go no farther. Slider 42 is locked into position above box 50 and provides an immobile and aligned entrance 96. Encompassing molding 40M is lowered over box 50 and provides a single entrance 96, for coupling. This also forms the female half-buckle 104 that the user uses to initially close or buckle the zipper. The user releases buttons 42B and lock 42L.

To couple the zipper, the user places the thumb of the left hand on thumb hold 86A and intergarment plate 86, and likewise places the thumb of the right hand on thumb hold 88A and intergarment plate 88, on the two sides of the jacket. The user pushes male interlocking member 60 into entrance 96. Guiding space bar 76G allows coupling element 76 to slide over entrance 96. This couples female half-buckle 104 with male half-buckle 106 and instantly couples the zipper. The user then squeezes buttons 42B simultaneously and draws slider 42 and encompassing molding 40M in a closing direction to close the zipper along its length. In this embodiment, the closure system is initially coupled laterally at the hem of the jacket and the full length of the garment is coupled vertically, by drawing slider 42/40M to the terminal end of the zipper. The user can place their fingers on encompassing molding 40M instead of intergarment plate 86, if so desired.

To uncouple the zipper, the user draws slider 42, lock 42L and molding 40M, to the initiating end and releases buttons 42B, locking slider 42 in place. The user lifts elongated coupling element 76 and interlocking member 60 up and out of slider 42, and box 50, in a direction perpendicular to coupling, uncoupling the zipper. This embodiment is best uncoupled with two hands.

If a male interlocking member having a zig zag, angled, or other shape is desired, a socket member with a corresponding or suitable aperture is used. In this case the slider may be aligned not along the lines of the socket member, but aligned in a predetermined position that facilitates coupling with this interlocking member and facilitates dependable operation of the closure system.

When the components of the female side of the slide fastener, on elongated coupling element 62, are non-moving and aligned, it removes the encumbrances the user usually faces when coupling a zipper or slide fastener. The user usually has to thread the male coupling member through a moving slider and then into a fixed socket member. Arresting and aligning the slider provides a simple, single socket and makes coupling almost effortless, for both traditional and instant, snap-lock, lateral coupling. The arrested and aligned closure systems are used for both separable zippers and non-separable zippers, and many other uses.

FIG. 1A—Dead Person's Self-Locking Slider without Molding

Figure 3:
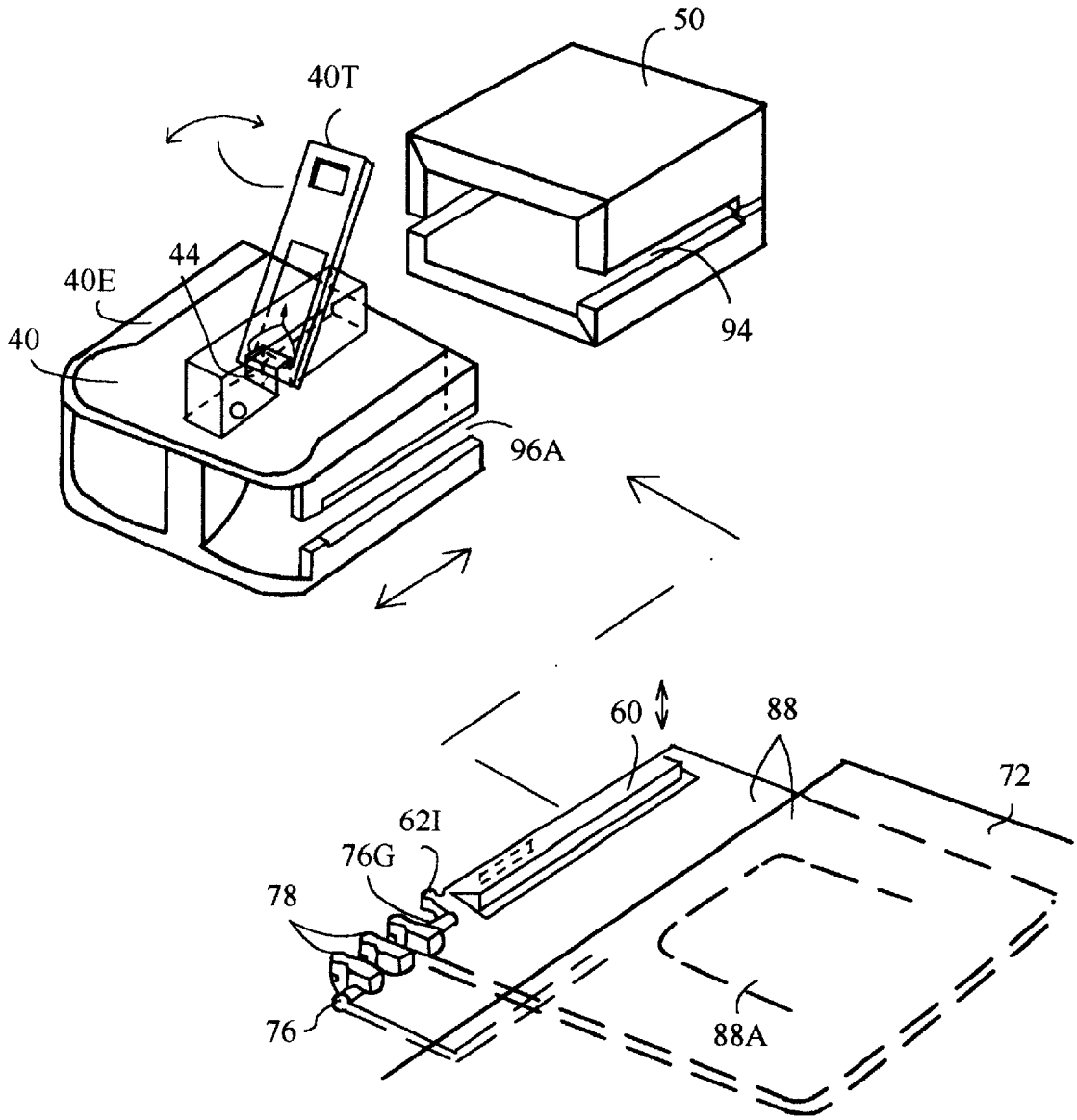
FIG. 3 is a perspective view of a third embodiment showing an immobile and aligned closure system using a resilient, locking tab holder.

FIG. 1A shows slider 42S with lock 42L however it does not have encompassing molding 40M, or a non-encompassing molding 40E (FIG.3). Lock 42L arrests the movement of slider 42 and aligns its position properly for coupling. Slider 42S does not need encompassing molding 40M to arrest its movement, align slider 42S, or provide dependable coupling.

FIG. 1A—Operation of Dead Person's Self-Locking Slider without Molding

The dead person's self-Locking slider 42S without molding operates in the same manner as slider 42, but without the encompassing or non-encompassing molding. The user pushes in buttons 42B and slides slider 42S to the initiating end of elongated coupling element 62, above socket member 50 (or other socket member), releasing buttons 42B and creating an immobile and aligned socket entrance 94/96A (see FIG. 3). The user pushes male member 60 (FIG. 1) into the aligned and immobile entrances 94 and 96A, instantly coupling the zipper. Slider 42S is drawn in closing motion to close the length of the zipper. Member 60 is uncoupled by drawing member 60 in an upward direction out of socket box 50 and slider 42S.

FIG. 1B—Dead Person's Self-Locking Operating System

FIG. 1B shows an enlarged view of lock 42L. In addition to buttons 42B, lock 42L has an operating system comprising resilient material or flanges 42R, such as metal, plastic, or other material, which is located inside lock 42L. The lower end of the resilient flanges comprises locking member 42C. Member 42C protrudes through void 42V to reach in-between two consecutive teeth 64, when it is in its locked position. Void 42V is adapted to take on various shapes to accommodate the many possible shapes of lock 42L and member 42C.

Figure 1C:
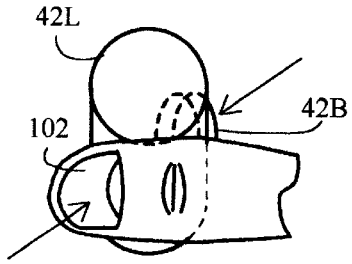
FIG. 1C is the enlarged perspective view of the pull tab of FIG. 3, showing the placement of the thumb for operation of the sliding zipper head.

FIG. 1C—Placement of the Users Fingers for Operation

FIG. 1C illustrates a finger 102 pushing upon button 42B in the front of lock 42L (hidden). The casing of lock 42L is static and fixed to the surface of slider 42, unlike a traditional zipper slider tab which is free to move forward and backward on a small crosspiece. The lower portion of the index finger would typically be used to push in button 42B that is placed in the rear of lock 42L (not shown for clarity). Having two fingers squeeze buttons 42B simultaneously (as shown by the direction of the two arrows one in the back of lock 42L, and one in the front), allows for even pressure upon flanges 42R to raise member 42C. Two fingers and two buttons 42B are used for these illustrations, however lock 42L is adaptable to operate with a single button 42B, or alternate design, if desired.

Figure 1F:
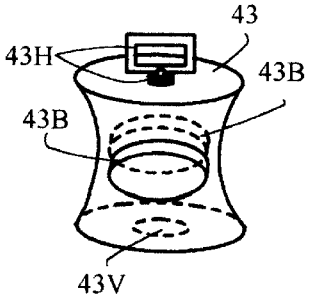
FIG. 1F is an enlarged perspective view of a modification of the automatic dead person's lock pull tab of FIGS. 1–1E.
Figure 1D:
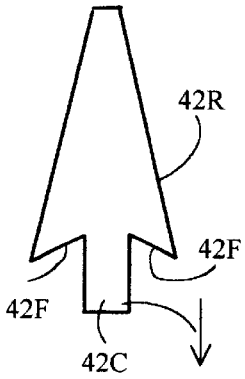
FIG. 1D is an enlarged plan view of the automatic dead person's lock mechanism in its locked position, which operates within the pull tab.
Figure 1E:
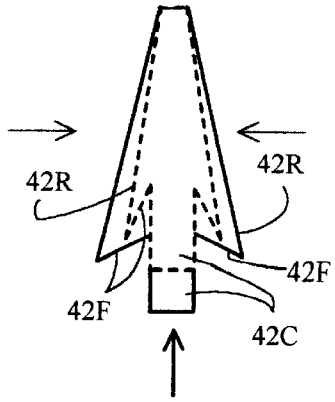
FIG. 1E is an enlarged plan view showing the movement of the automatic dead person's lock mechanism going from a locked position (solid line) to an unlocked position (dotted line).

FIGS. 1D–E—Dead Person's Operating System

FIG. 1D shows the resilient operating members of locks 42L, while it is in its locked position. Flanges 42R and 42F are designed to pull locking member 42C in an upward position, when the user simultaneously pushes buttons 42B toward each other.

FIG. 1E shows FIG. 1D after flanges 42R and 42F have been pressed toward one another by buttons 42B as shown by the dotted lines. Flanges 42F, when pushed by flanges 42R, move in an upward direction. This pulls attached member 42C in an upward direction out of the in-between position of two teeth 64 (or others), which unlocks slider 42.

FIG. 1F—Modification of the Dead Person's Lock

FIG. 1F shows lock 43L, which is a variation in the shape of lock 42L. Lock 43L has an oval shape with oval buttons 43B to accommodate a more relaxed activation of the zipper pull tab or lock 43L. Buttons 43B (and 42B) can protrude from lock 42L or 43L or can be set more inside the depth of locks 42L and 43L. Lock 43L is shaped to comfortably accommodate the fingers of the user. Locks 42L and 43L can be much larger than slider 40 itself, for ease of use, or to provide a modern appearance.

A holder 43H on the top of lock 43L is available to hold a length of material or novelties. Holder 43H is adaptable to be a plastic or metal, etc., buckle half which snaps into the top or side of lock 43L (or other tabs) and then snapped together with a second buckle half sporting a novelty, such as a skier's lift ticket holder, key holder, compass, utility knife, whistle, cord and cord stopper, etc. Multiple holders are adapted to be used in sequence, singularly, or alternately, if desired. Holder 43H is adapted to be used on any of the disclosed pull tabs or as the pull tabs. Holder 43H has a hinge(s), swivel hardware or both, if desired. Holder 43H can be a metal or plastic, loop that is drilled through lock 42L.

Pull tab or locks 42L or 43L are also designed to be used in a handle shape, resembling the upper end of a handle of a mug, that is tipped on its side. This handle is large enough to accommodate the index finger of the user. The thumb is placed on the very top outside of the handle, while the index finger is placed on the inside of the handle. Buttons 42B or 43B are situated under this placement of the fingers on the outside and inside of the handle.

Figure 1G:
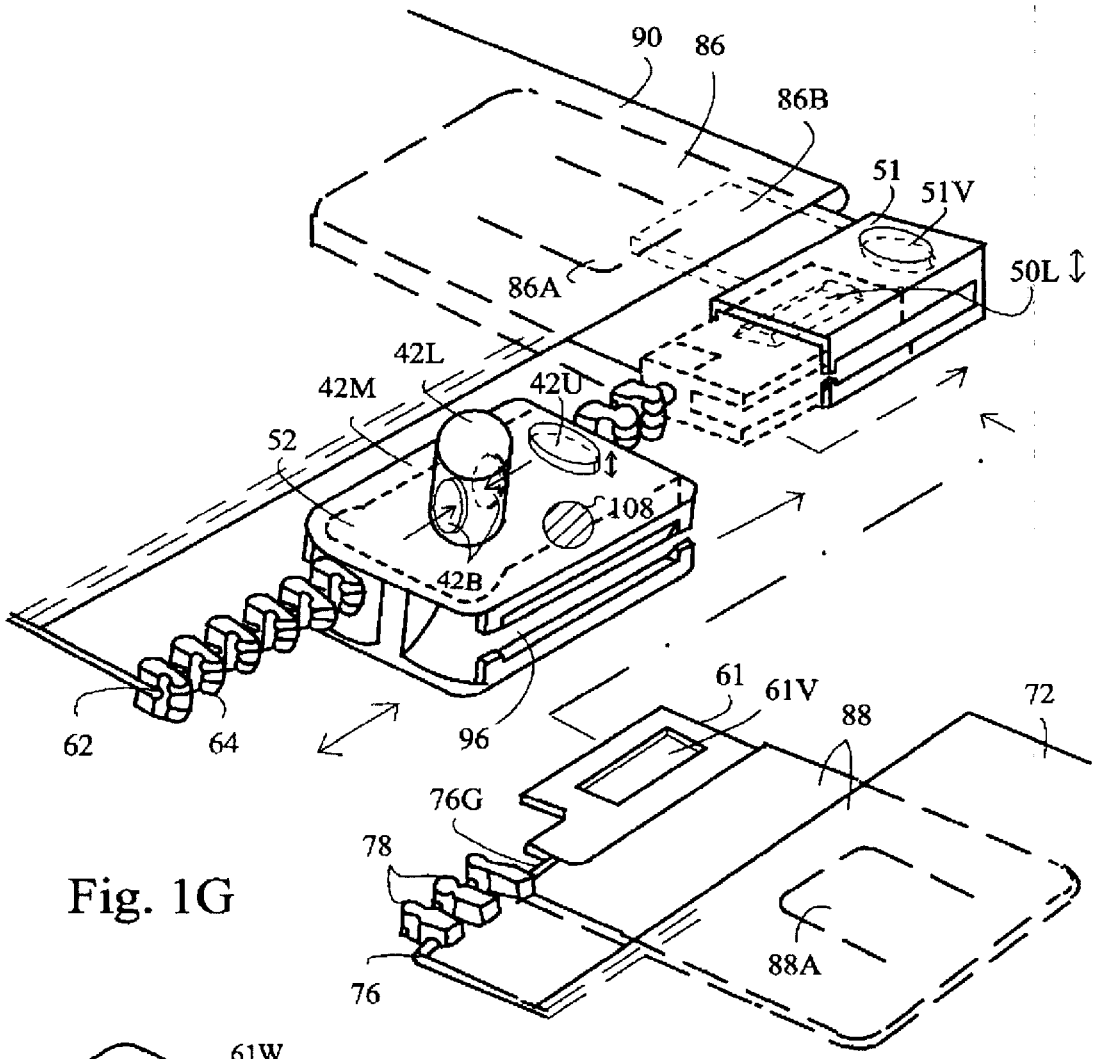
FIG. 1G is a perspective view of a modification the automatic dead person's lock pull tab that is coupled with a spring-lock and a non-resilient male interlocking member.

FIG. 1G—Modification of Dead Person's Zipper Head Coupled with Spring-Lock Assembly and Non-Resilient Male Interlocking Member In this modification, the dead person's lock is used with a spring-lock assembly 50L that initially locks elongated coupling elements 62 and 76 together with a non-resilient, male interlocking member 61. Assembly 50L is housed inside a full length socket box 51 or on elongated coupling element 62. Assembly 50L has resilient materials such as a spring(s) or a resilient flange(s) of plastic, metal, a combination of plastic and metal or other working resilient material. Assembly 50L is illustrated as having a resilient elongated button with tapered edges. Assembly 50L can resiliently move up and down for operation of the zipper, as shown by the arrow. Member 61 is located on the initiating end of elongated coupling element 76. Assembly 50L is located at the initiating end of elongated coupling element 62. Member 61 has a void 61V that interengages and locks with resilient assembly 50L. Slider 52 has a full length encompassing molding 42M that will encompass a full length socket member 51.

FIG. 1G shows a housing 86B, which is located inside intergarment plate 86. Housing 86B is hidden inside plate 86 and is a cavity for housing a large or wide interlocking male member, when coupled, that is larger or wider than a regular male interlocking member, the slider, or other aligning components. Providing a bigger or wider male interlocking member is often easier to couple than a small one, especially if you are a child or are wearing gloves. Housing 86B can be any size or shape to accommodate any size and shaped male interlocking member. Housing 86B is not needed in this figure, but is shown as an example. A soft-touch material, such as a soft rubber or plastic 108, illustrated in a circle for clarity, can softly coat the touchable areas for the comfort of the user.

FIG. 1G—Operation of Modification of Dead person's Zipper Head Coupled with Spring-Lock Assembly To operate this modification, the user moves slider 52 and molding 42M to the initiating edge of elongated coupling element 62 by simultaneously compressing buttons 42B on lock/tab 42L. Slider 52 encompasses box 51 and assembly 50L. When buttons 42B are released, lock 42L locks the movement of slider 52, including lateral movement. This provides a non-moving and aligned entrance for lateral coupling. The user pushes member 61 into entrance 96. Edge 76G guides member 61 properly through entrance 94 and box 51. Member 61 is pushed against a tapered edge of assembly 50L and moves assembly 50L down. When member 61 slides over assembly 50L, void 61V passes over assembly 50L. Assembly 50L pops up into void 61V, resuming its original shape, and initially locking elongated coupling elements 62 and 76 together. The user closes the length of the zipper by simultaneously compressing buttons 42B and pulling slider 51 by tab 42L in a closing direction.

To uncouple assembly 50L, the user pulls member 61 in an opposite direction of coupling, out of box 51. This pushes member 61 against a tapered edge in the rear of assembly 50L, which pushes assembly 50L down, disengaging member 61. The user can also press down and release the resilient member itself with their thumb through a window or void 51V, in the upper surface of the female half of the buckle 104 or a button 42U, or other releasing mechanism can be provided. The user can press an attached button to unlock a resilient flange, or use a remotely positioned button to release the coupling.

Slider 52 or female half-buckle 104, if provided with a tapered projection inside (not shown), can automatically uncouple the zipper. When slider 52 is drawn to the initiating end this projection slides over button 42U and uncouples the zipper, projecting member 61 out of socket 94 with momentum. This embodiment can be uncoupled with one finger, one hand or two hands.

Figure 1H:
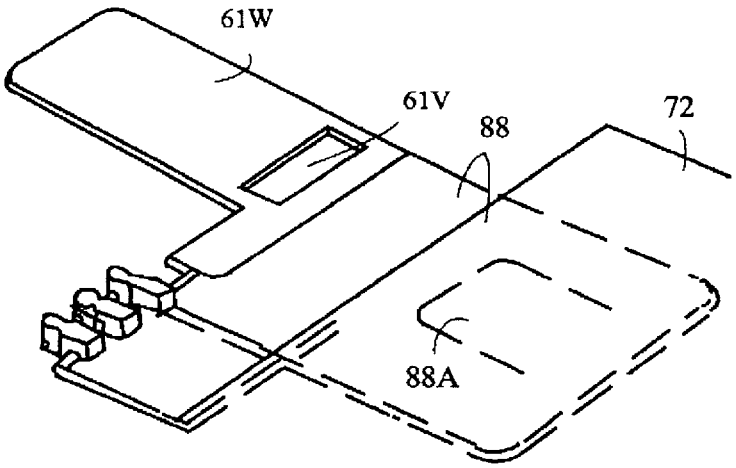
FIG. 1H is a prespective view showing a wide male interlocking member of the Immobilized and Aligned Closure System.

FIG. 1H Wide Male Interlocking Member

FIG. 1H illustrates a wide male interlocking member 61W. Wide male member 61W is a wide modification of interlocking member 61. Wide male member 61W is used with spring-locking assembly 50L to couple the zipper. It is wider than self-locking slider 52 and when locked, reaches into housing 86B in intergarment plate 86, which is hidden within fabric 90. Wide male interlocking member 61W has increased surface area and makes the zipper easier to couple, especially if you are a child or are wearing gloves.

Figure 2:
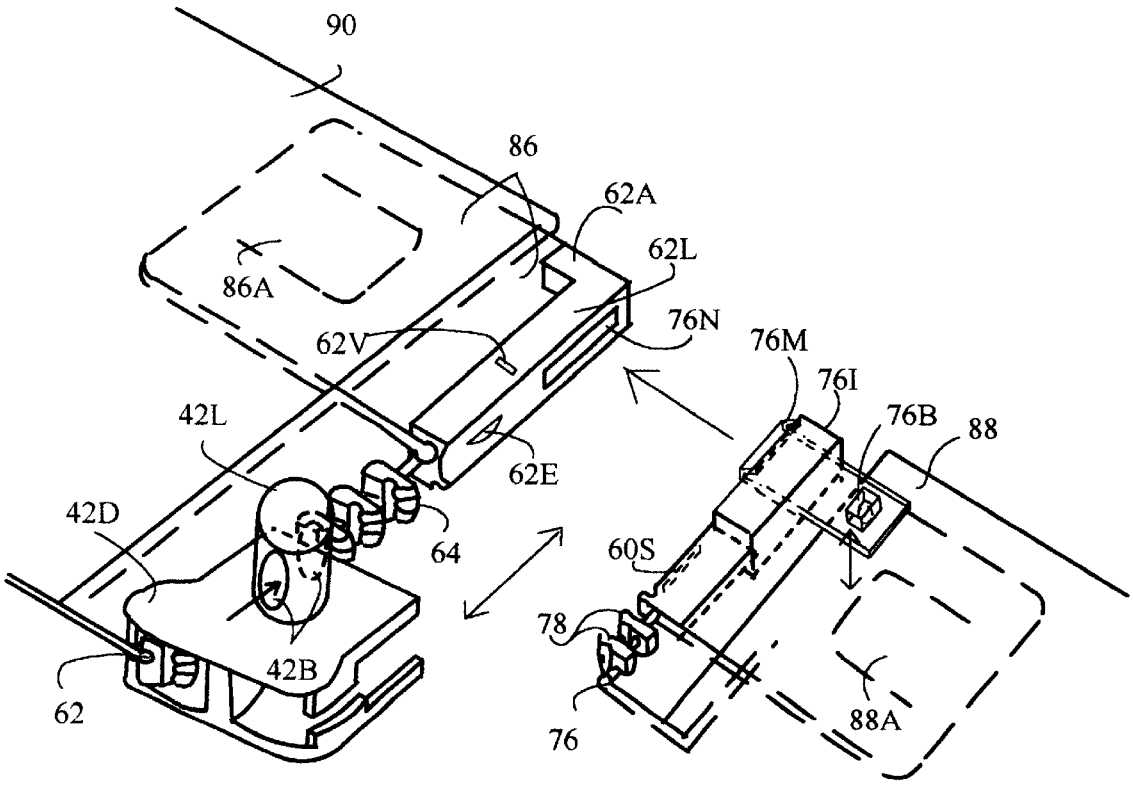
FIG. 2 is a perspective view of a second embodiment showing initial coupling of the two elongated coupling elements, without a socket member or male interlocking member.

FIG. 2—Description of Second Embodiment—Self-Locking Elongated Coupling Elements and Self-locking Slider FIG. 2 illustrates a dependable zipper with a minimum number of components. Three main components are used, a self-locking slider 42D, elongated coupling element 62, and elongated coupling element 76. Self-locking slider 42D is slidably connected to elongated coupling element 62. An abutment 62A keeps slider 42D from leaving elongated coupling element 62. The initiating end of elongated coupling element 62, end 62L directly snaps together with the corresponding end of elongated coupling element 76, end 76I. Slider 42D has a differentiated entrance on its open side, with wide and narrower portions, which allows for lateral coupling with elongated coupling element 76I. A release button 60B releases the connection for uncoupling. A void 62V is located on the top of end 62L, for the placement of locking member 42C. (Slider 42D if placed any where along the elongated coupling elements is arrested from movement and aligned in a horizontal position).

FIG. 2—Operation of Self-Locking Elongated Coupling Elements with Self-locking Slider To operate this arrested and aligned closure system, the user squeezes buttons 42B simultaneously and draws slider 40D to the initiating end of the zipper. Slider 42D goes over end 62L and is stopped by abutment 62A. Locking member 42C (FIGS. 1D, 1E) projects into void 62V in the top of elongated coupling element 62L. This arrests movement of slider 42D, including lateral movement. It also provides an immobile entrance for coupling with elongated coupling element 76I. Elongated coupling element 76I has a male interlocking portion 76M that engages and locks with a socket 76N in elongated coupling element 62L. The user places end 76I with male member 76M into entrance 96D and snaps ends 62L and 76I together, initially coupling the zipper. The user then squeezes buttons 42B and draws slider 40D along elongated coupling elements 62 and 76 to close the length of the zipper.

Slider 42D, if placed on a shorter elongated coupling element 62L, will lock between two consecutive teeth 64 and 78. Having a self-locking slider is beneficial, as slider 42D locks its own movement and provides an immobile and aligned socket by itself. This closure system does not depend upon another member of the zipper to provide an immobile and aligned socket for dependable coupling, and can do so without other members present.

To uncouple the zipper, the user squeezes buttons 42B and draws slider 42D to the initiating end of the zipper and releases buttons 42B. The user presses button 76B, uncoupling the zipper.

Figure 3A:
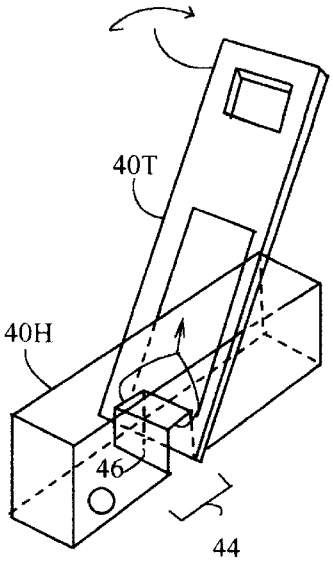
FIG. 3A is a perspective enlarged view of the top of the sliding zipper head of FIG. 3, with a resilient, locking tab holder.
Figure 3B:
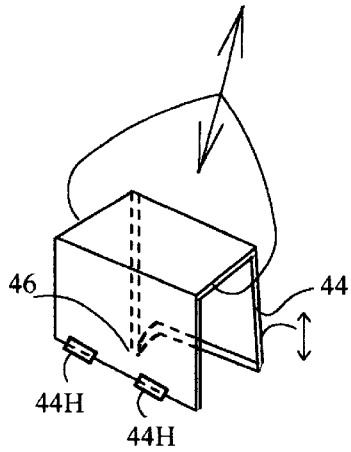
FIG. 3B is an enlarged perspective view of the resilient locking tab holder of FIG. 3A.

FIGS. 3–3B—Description of Third Embodiment Using Slider with Tab Holder Locking Device FIG. 3 shows a third embodiment using a self-locking zipper head or slider 40, a non-encompassing molding 40E and a socket box 50. Non-encompassing molding 40E extends beyond the edges of slider 40 to provide a dependable socket for coupling but does not encompass socket box 50 or other members. Slider 40 has a pull tab holder 40T, and a resilient locking bridge or tab holder 44, with a locking projection(s) which can solely arrest the movement of slider 40 and align slider 40 for reliable, immobile coupling. The movement of tab 40T locks and unlocks, aligns and immobilizes slider 40 so the zipper can be coupled effortlessly, even laterally, without movement in the slider. Molding 40E surrounds a large portion of slider 40 and provides a guiding entrance 96A/94 for coupling. Plate 88 is stiff and has resilient male interlocking member 60, which forms the male half 106 of the two-piece interlocking lateral buckle. Elongated coupling element 76 and its interlocking teeth 78 extend from the upper side of plate 88 for instant and smooth initial coupling of the elongated coupling elements. Plate 88 has a guiding edge 76G, which brings coupling element 76 through entrance 94 for coupling.

Molding 40M can also encompass box 50 (as in FIG. 1) to join slider 40 and box 50 together. This provides a unified, guiding entrance for coupling (FIGS. 3A, 4–13A). Even though slider 40 is already immobilized, encompassing molding 40M further immobilizes slider 40 by unifying or bridging slider 40 and box 50 together. This is because the components are located on a fabric elongated coupling element, which can move. Immobilized and guiding entrance 94 of slider 40, combines with the guiding entrance 96 of box 50 to provide a unified and aligned entrance for coupling with member 60. Molding 40E widens slider 40 so it matches the dimensions of box 50 and provides a streamlined aligned entrance 96A/94.

This immobile and aligned closure system provides dependable, immobile, instant coupling using only a single arresting member, slider 40. Slider 40 is able to arrest its own movement and align itself with box 50, or another socket member, for a simply operated, dependable closure system. Molding 40 can reach up and extend from box 50 (or other member) to bridge slider 40 and box 50 together to provide a unified and guiding entrance for coupling.

A two-way immobilized and aligned zipper has two independent, self-locking sliders 40 (40D, 42, 42S) which are placed back-to-back (or front to front) and provide an aligned, and immobile entrance for coupling. This back-to-back position is familiar in the prior art and is therefore not shown. The self-locking features of the slider(s) are seen in FIGS. 1–3E. An aligned and immobilized two-way zipper couples quickly and enables the user to gain access to an inner garment or compartment of luggage, (or other article). Having a two-way zipper also provides comfortable seating, such as in a car, train, etc., since the bottom of the garment can be opened without removing the outer garment.

A reversible, immobilized and aligned zipper is provided by placing self-locking tab holders, locking tabs, on both the front and back sides of the slider. An immobilized and aligned interlocking buckle is reversible for initially coupling the closure system and has inset (or other) pull tabs on both sides of the buckle and is operable from both sides. It can also accommodate a single slide over pull tab that moves from a front plate of the slider/buckle to the back and vice versa, for easy operation of a reversible garment, etc.

FIG. 3A shows tab holder 44 locking slider 40. The top of tab holder 44 moves up and down slightly as tab 40 is lifted and lowered (shown by the arrows). FIG. 3B shows an enlarged perspective view of tab holder 44 where claw 46 can be clearly seen. Hinges 44H, extended metal or other material hold tab holder 44 to slider 40 and allow tab holder 44 to be raised and lowered for operation of claw 46.

Tab holder 44 is resilient and arches upward when tab 40T is lifted. When tab 40T is lowered, tab holder 44 pushes down upon tab 40T and forces it down into a locking position. Tab holder 44 has a locking projection or claw 46, which is located on the bottom of one or more edges of tab holder 44. Claw 46 projects through an opening or void in the top plate of slider 40, (or elsewhere) when tab 40T is placed in a down or resting position (forward or backward), into a space between two consecutive interlocking teeth 64 (FIG. 3). This prevents any further lateral, anterior/posterior, and vertical movement of slider 40, which allows movement-free, dependable lateral and traditional coupling of the slider.

FIG. 3—Operation of Self-Locking Slider with Tab holder

Slider 40 is pulled along an elongated coupling element 62 by tab 40T until it is flush against box 50. When tab 40T is lowered, tab holder 44 is lowered, and prong 46, located underneath tab holder 44, grabs into elongated coupling element 62 and movement is arrested. Resilient member 60, with an attached elongated coupling element 76, interlocking teeth 78, and intergarment plate 88 is then inserted laterally by the user into immobile and aligned entrance 94/96A, immediately locking slider 40 and box 50, with member 60, locking the initiating ends of the zipper. Member 60 depresses while going through entrance 94/96A, and then springs up inside socket member 50, along side a complementary shaped stationary pin (or complementary designed interior of box 50, or elongated coupling element 62), locking the ends together. The initially locked ends of elongated coupling elements 62 and 76 can then be closed all along its length by drawing slider 40, in a closing direction, by lifted and unlocked tab 40T.

Traditional coupling (from the top) is also easier since box 50 is immobile and slider 40 is arrested from movement. The cavities of slider 40 and box 50 are arrested and aligned, leaving a single, smooth, immobile and aligned interior entrance for coupling from the top.

Figure 4C:
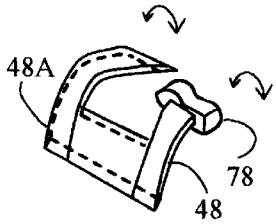
FIG. 4C is an enlarged perspective view of a third modification of the self-locking zipper pull tab, using a locking claw and a zipper tooth to arrest and align the sliding zipper head.
Figure 4A:
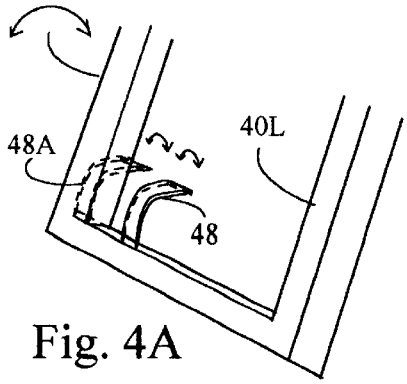
FIG. 4A is an enlarged perspective view of a first modification of the self-locking zipper pull tab of FIG. 4, which has two locking claws.
Figure 4:
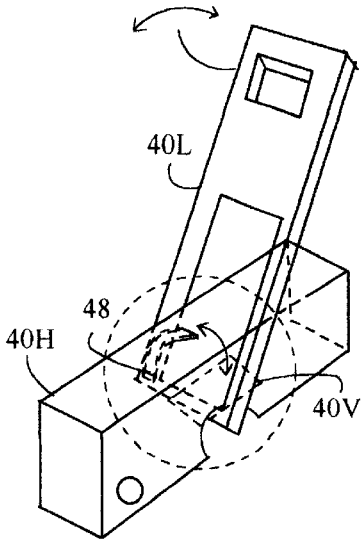
FIG. 4 is an enlarged perspective view of a fourth embodiment showing a self-locking zipper pull tab with an engaging claw.

FIG. 4—Description and Operation of Fourth Embodiment with Locking Pull Tab Claws FIG. 4 is a fourth embodiment, showing an alternative method of arresting the movement of slider 40 as seen in FIGS. 3, 3A, and 3B. In this method, a locking projection or claw 48, is directly attached to pull tab 40L. When tab 40L is placed in a resting position, claw 48 is automatically lowered and protrudes through a through-hole or void 40V in the upper plate of slider 40 and comes to rest within a position between two consecutive teeth 64, locking slider 40 in place.

The open sides of slider 40, entrance 94, and the open side of box 50, entrance 96, are designed to form a unified, guiding immobile entrance 94/96, when slider 40 is lowered flush against box 50. Claw 48 arrests all movement of slider 40, including lateral movement, so the zipper can be reliably coupled laterally, through unified entrance 94/96, without any movement in slider 40.

FIG. 4A—Description and Operation of Dual Locking Pull Tab Claws

FIG. 4A shows a first modification of tab 40L which has dual locking projections or two claws 48 and 48A. Claws 48 and 48A are locking projections that arrest movement of slider 40. Claw 48 lowers into a space between two teeth 64 on elongated coupling element 62, as in FIG. 4. Claw 48 locks along the entire width of teeth 64. This squares off the position of slider 40 with box 50 and ensures that the entrance of slider 40 is arrested in an aligned proper position with the entrance of box 50. This creates a unified immobile entrance 94/96 for dependable, initial coupling of the zipper.

Claw 48A protrudes into the fabric of elongated coupling element 62 outside of teeth 64. Claw 48A is provided with a sharper or pincer tip in order to sufficiently grab elongated coupling element 62 to arrest the movement of slider 40. Claw 48 is designed, however, not to damage or tear the fabric of elongated coupling element 62.

Figure 4B:
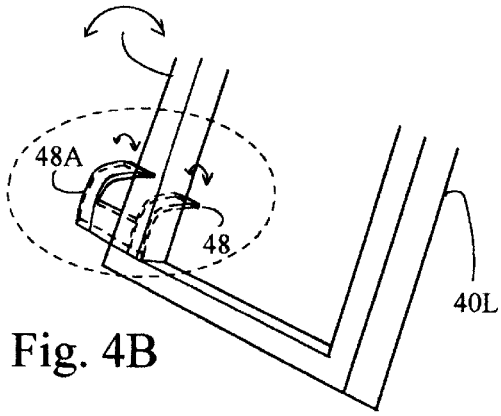
FIG. 4B is an enlarged perspective view of a second modification the self-locking zipper pull of FIG. 4, having a combined fabric locking claw and a tooth locking claw.

FIG. 4B—Description and Operation of Combined Locking Projections

FIG. 4B shows a second modification of tab 40L with combined locking projections or claw 48/48A. Claw 48/48A is a wide claw that reaches both through teeth 64 and out onto the fabric tape of elongate coupling element 62. Claw 48/48A incorporates both a flattened tapered projection to fit between two consecutive teeth 64 and a sharp pincer 48A to grab onto tape 62. It simultaneously arrests the movement of slider 40 between teeth 64 and elongated coupling element 62, when tab 40L is lowered, and more substantially arrests lateral movement of slider 40.

FIG. 4C—Description and Operation of Locking Claw with Zipper Tooth

FIG. 4C shows a third modification of the locking tab 40L. The locking surface of claw 48 is the shape of a complementary zipper tooth 78 of the opposite side of the zipper on elongated coupling element 76. When claw 48 is lowered in between two teeth 64, claw 48 with tooth 78 takes up the negative space between two consecutive teeth 64. As a result, engaging claw 48 squares off the position of slider 40, aligns slider 40 with socket member 50, and arrests lateral, vertical and anterior/posterior movement of slider 40. Tab holder 44 leaves room underneath for the swinging movement of prong 48/78. When slider 40 is drawn to the initiating edge of elongated coupling element 62 and is flush against box 50 and locked, an arrested and aligned entrance 94/96 is provided for snap-lock lateral coupling or movement free traditional coupling of the zipper.

Figure 5:
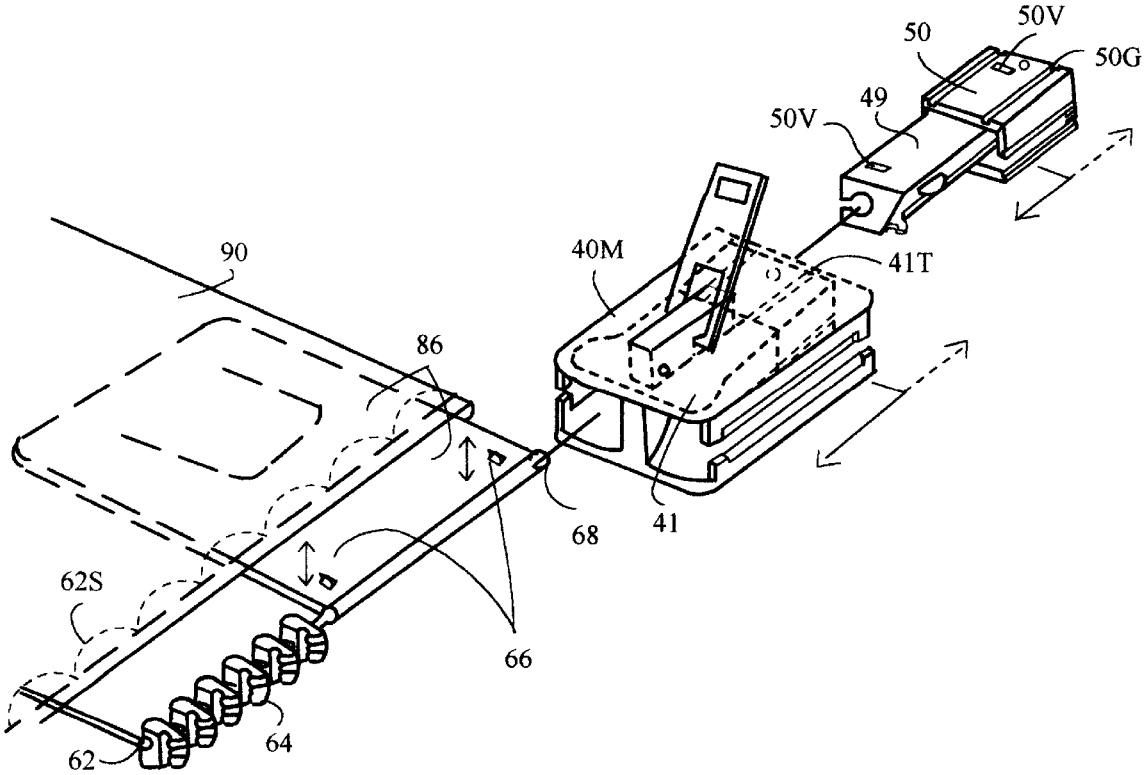
FIG. 5 is a perspective view of a fifth embodiment showing the stages of the component-free installment method and improvement to an immobilized alignment closure system.

FIG. 5—Description of Fifth Embodiment, Easy-to-Sew Installation Method and Improvement to Immobilized Alignment Closure System FIG. 5 is a fifth embodiment, and the first of six illustrations (FIGS. 5–10) showing an easy-to-sew installation method of immobilized and aligned closure systems. This easy-to-sew installation method is also an improvement to the invention in my U.S. Pat. No. 6,026,547 (2000). This method of installation benefits both these closure systems. However, for the facility of understanding, slider 41, the slider labeled as the slider of the Immobilized Alignment Closure System in this disclosure, will be discussed. According to this closure system, molding 40M and 40E, including encompassing molding, is used for both closure systems, if desired. Guiding and retaining devices, such as tongue and groove members, snug bumps and the like, can also used for both.

Elongated coupling element 62 is sewn with thread 62S (or attached in other manner) onto fabric 90 before coupling slider 41, stationary pin 49, and socket box 50 are installed on elongated coupling element 62. Slider 41 is shown with molding 40M which encompasses box 50 to further arrest the movement of slider 41 and provide a unified, guiding entrance for coupling. Slider 41 has interlocking tongues 41T that align with interlocking grooves 50G in box 50, for alignment.

Elongated coupling elements 62 and 76 are sewn onto fabric 90 and 92 (FIG. 1), respectively, before the zipper components are put on elongated coupling elements 62 and 76. Since slider 41, stationary pin 49 and socket box 50 are not on elongated coupling element 62 at the time of sewing, the sewing machine can easily sew elongated coupling element 62 onto fabric 92 from end to end without having to go around or above the other components. This allows for consistent, cleaner and uninterrupted stitches for a more secure and easier attachment of the elongated coupling elements to the fabric. Sewing freely while installing a zipper also increases productivity, especially during mass production. Elongated coupling element 76, on the opposite side of the zipper, usually does not have bulky components and is easily sewn onto fabric 92. If elongated coupling element 76 does have bulky components in other embodiments, elongated coupling element 76 is sewn on prior to installing the components in the same manner.

FIG. 5—Operation of Easy-to-Sew Installation Method

After elongated coupling element 62 is sewn completely onto fabric 90, slider 41 is placed onto elongated coupling element 62. After slider 41 is placed on elongated coupling element 62, stationary pin 49 and socket box 50 are placed on elongated coupling element 62. Elongated coupling element 62 has a set of resilient releasing locks 66 that are used to lock stationary pin 49 and socket box 50, as they are drawn onto elongated coupling element 62. The solid arrow of slider 41 shows that slider 41 is to be installed in that direction. The dotted arrow shows that slider 41 can be removed from elongated coupling element 62, once installed on elongated coupling element 62. The arrow of stationary pin 49 and socket box 50 also shows that once stationary pin 49 and socket box 50 are placed and locked onto elongated coupling element 62, they can then be released from locks 66 and removed in the opposite direction. Stationary pin 49 and socket box 50 have voids 50V that penetrate stationary pin 49 and give access to release locks 66, when needed. After installation of the zipper, slider 41 encompasses stationary pin 49 and socket box 50 to provide a single entrance for instant and rapid coupling of the zipper, similar to that shown in FIG. 1.

Figures 6, 6A:
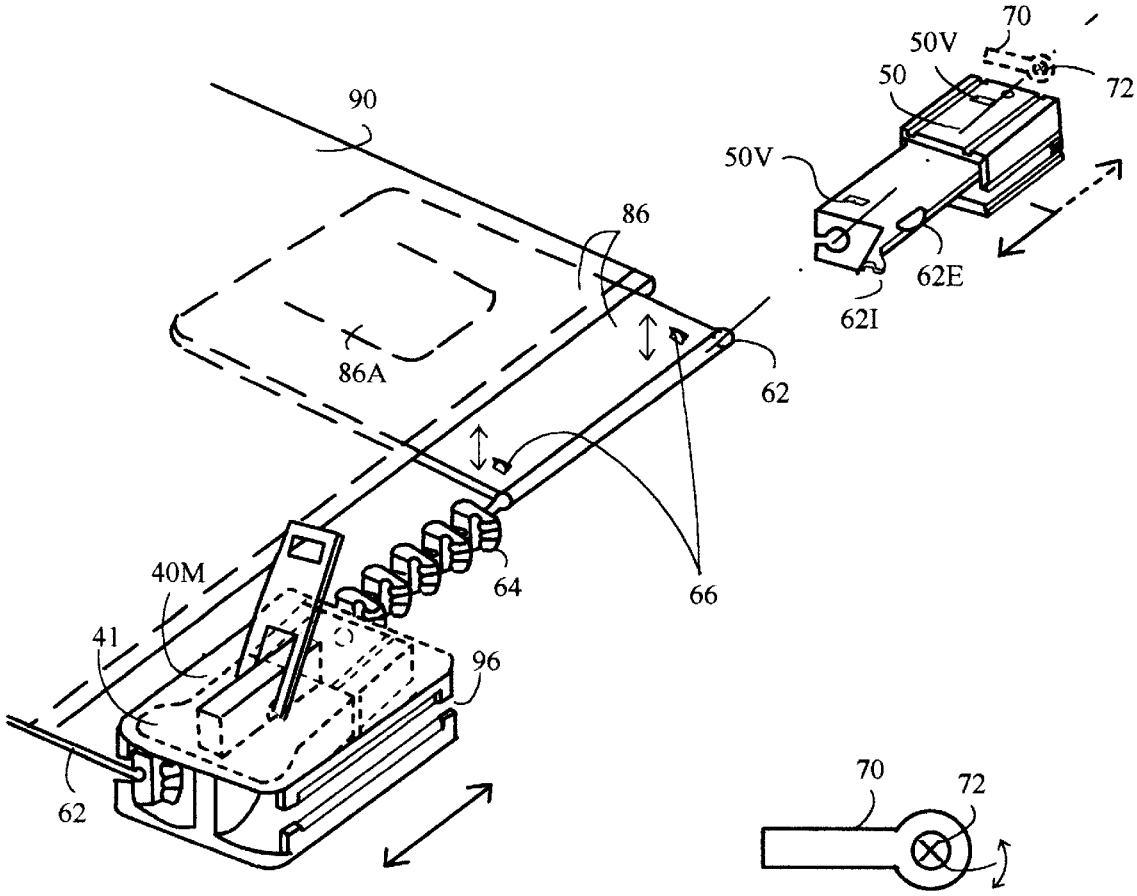
FIG. 6 is perspective view of a first stage of the releasable installment method, showing the installation of the coupling slider.
FIG. 6A is an enlarged plan view of a terminal lock of the first elongated coupling element.

FIG. 6—Description of Installation of Zipper Components

FIG. 6 is the second of six illustrations in the installation of the zipper. After elongated coupling element 62 is sewn onto fabric 90, slider 41 is placed onto elongated coupling element 62. Slider 41 is higher and slides freely over locks 66. Slider 41 is free to slide in either direction to close or open the zipper, as shown by the arrow. After slider 41 is placed onto elongated coupling element 62, stationary pin 49 and box 50 will then be placed and releasably locked onto elongated coupling element 62. Stationary pin 49 and box 50 are illustrated as a one piece unit but can be separate components, and be placed on separately in other embodiments or designed differently (or eliminated).

FIG. 6A—Description of Terminal Lock

FIG. 6A shows a terminal lock 70 of elongated coupling element 62. Terminal lock 70 is an extra lock that can be screwed in or affixed in another way to the terminal end 62T of elongated coupling element 62, to secure stationary pin 49 and socket box 50 to elongated coupling element 62. An activating member 72 is rotated to lock 70 onto end 62T. Lock 70 can be used in conjunction with locks 66 or in place of them, or be any design.

Figure 7:
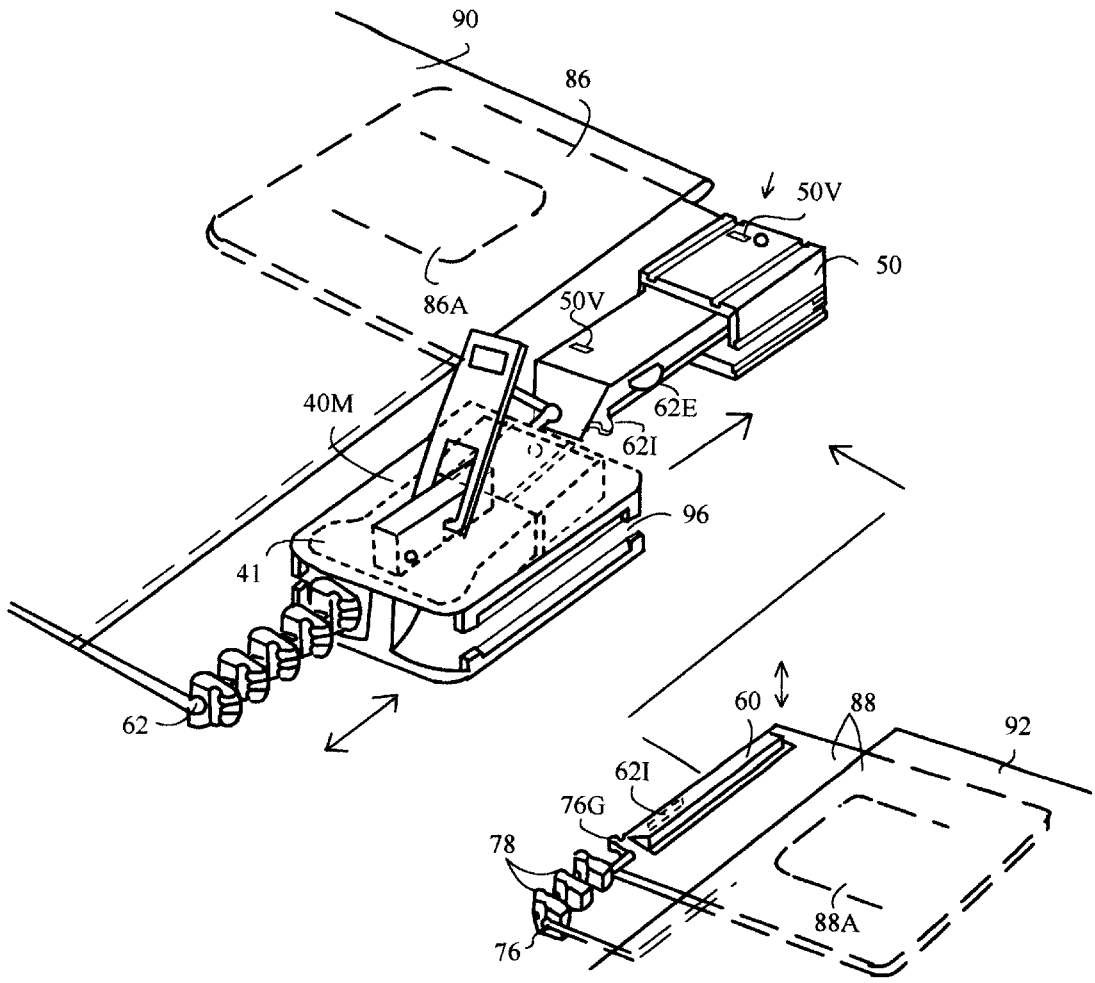
FIG. 7 is a perspective view of a second stage, showing the installation of the stationary pin and socket box, to be laterally coupled with the opposite side of the zipper.

FIG. 7—Description and Operation of Zipper with Releasably Locked Zipper Components FIG. 7 illustrates a third of six installation illustrations where stationary pin 49 and box 50 are shown as having been placed onto elongated coupling element 62, after slider 41, and either temporarily or permanently locked (as desired) into place by locks 66. Locks 66 are resilient and can be released. Slider 41, with encompassing molding 40M, is ready to be lowered over stationary pin 49 and box 50, aligning entrance 94 over the entrance of socket box 50. A lowering motion of tab 40T locks slider 41 and molding 40M in place and prevents movement of slider 41 for immobile snap-lock coupling with male member 60. Locks 42L and 43 are adapted to be used as well, if desired.

Figure 8:
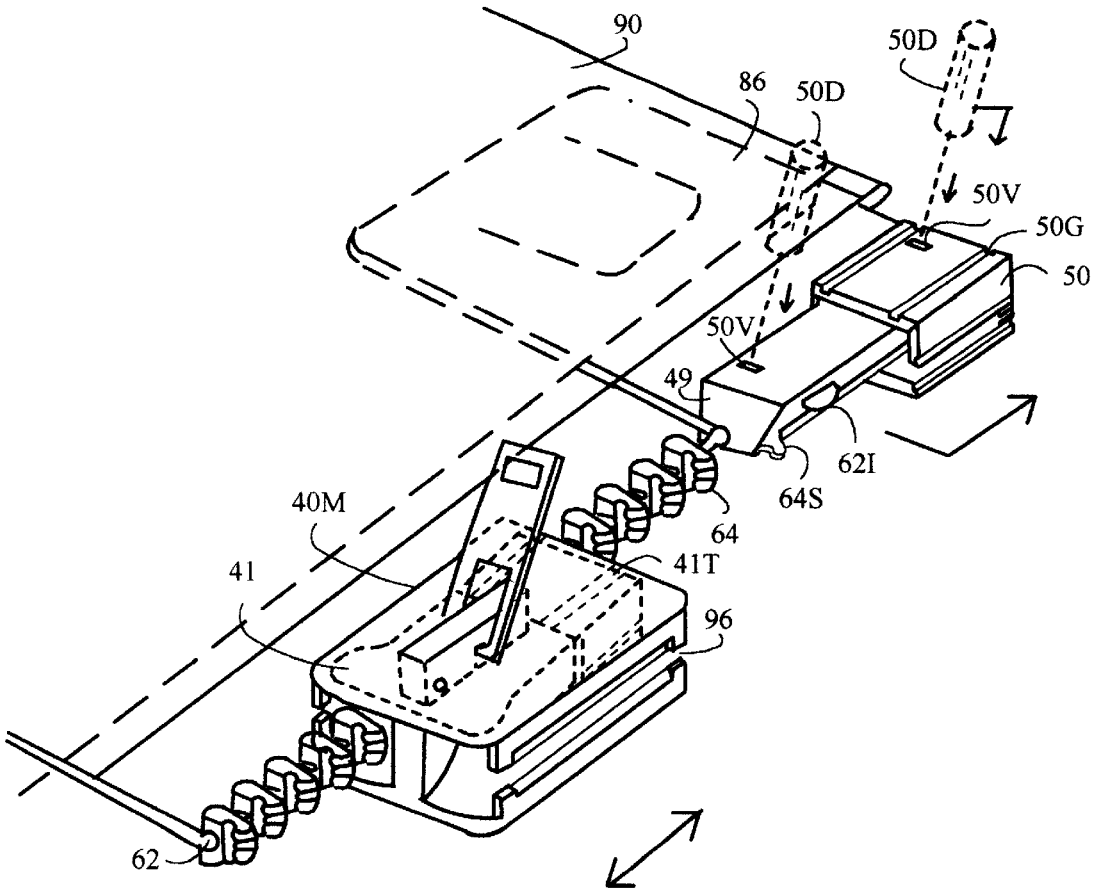
FIG. 8 is a perspective view of a third and detachment stage of the stationary pin and socket box.

FIG. 8—Description of Removal of Zipper Components When Desired

Figure 8A:
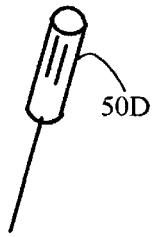
FIG. 8A is a perspective view of a single detaching tool.

FIG. 8 illustrates a fourth of six installation illustrations, showing the removal of socket box 50 and stationary pin 49, with a disengagement tool 50D (FIG. 8A). If an installer, by accident, happens to place stationary pin 49 and box 50 on elongated coupling element 62 before sliding slider 41 on first, or places slider 41 on upside-down, or inverted, the installer can release locks 66 by pushing down on lock 66 with tool 50D through voids 50V, on stationary pin 49 and box 50. The installer can remove stationary pin 49 and box 50 from elongated coupling element 62. Then the installer can correct the mistake and place slider 41 and then stationary pin 49 and box 50 back onto elongated coupling element 62 (or correct the direction of slider 41) for proper installation. Releasable locks 66 can save zippers, zipper tape, and worker's time that would have been needed to correct inaccuracies, during manufacturing and installation. Locks 66 are sturdy enough to permanently install the components, without further heat sealing or other sealing methods.

FIG. 8A—Description and Operation of Single Disengagement Tool

FIG. 8A shows a single releasing or disengaging tool 50D used to separate the components from the elongated coupling element. Tool 50D is fitted through void 50V (or other void) and depresses lock 66. When lock 66 is pressed, void 50V has a small slotted area extending from void 50V that allows the installer to start moving the component to be removed, a short distance while tool 50D is still pushing down on lock 66. This allows the component to hold lock 66 down while the component is being removed, otherwise simultaneous holding of the lock and removal of the component cannot be done without a full length releasing slot through the component.

For the readers understanding, the operation of the slot is similar to the operation of a slot found in a sleeve of a compact disc binder, or holder, that has multiple pages. An elongated, slotted opening through the clear plastic over a single housed CD is provided for the removal of the CD. This slotted opening stems from the center of where the CD is located and extends outward in one direction, so the user can slide the CD out of the sleeve, from the outside of the plastic sleeve, long enough to provide sufficient surface area of the CD for the fingers to grasp. A full length releasing slot is not necessary and can divide or weaken the components. Releasing tool 50D can be any shape or design, depending upon the design, shape, or size of the zipper and the type of resilient, releasable lock used.

Figure 8B:
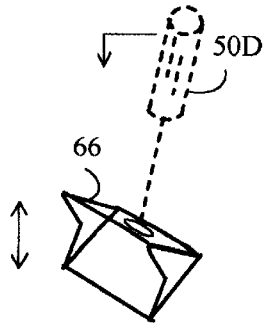
FIG. 8B is an enlarged perspective view of a releasing lock and a single detachment tool.

FIG. 8B—Description and Operation of Resilient Releasing Lock

FIG. 8B shows a releasing lock 66. The upper flange has a depression for the fitting of tool 50D. During installation, the component to be installed is slid onto elongated coupling element 62 and over locks 66. Locks 66 are resilient and are constantly reaching up to resume their original shape, when depressed. When the void of the component reaches the lock, the lock snaps up (down or out) into the void and prevents the component from moving any further. Releasable locks 66 can be of any design, including resilient shaped materials, button-type resilient locks, locks that resiliently turn sideways (would use a turning releasing tool) or any other releasing lock.

Figure 9:
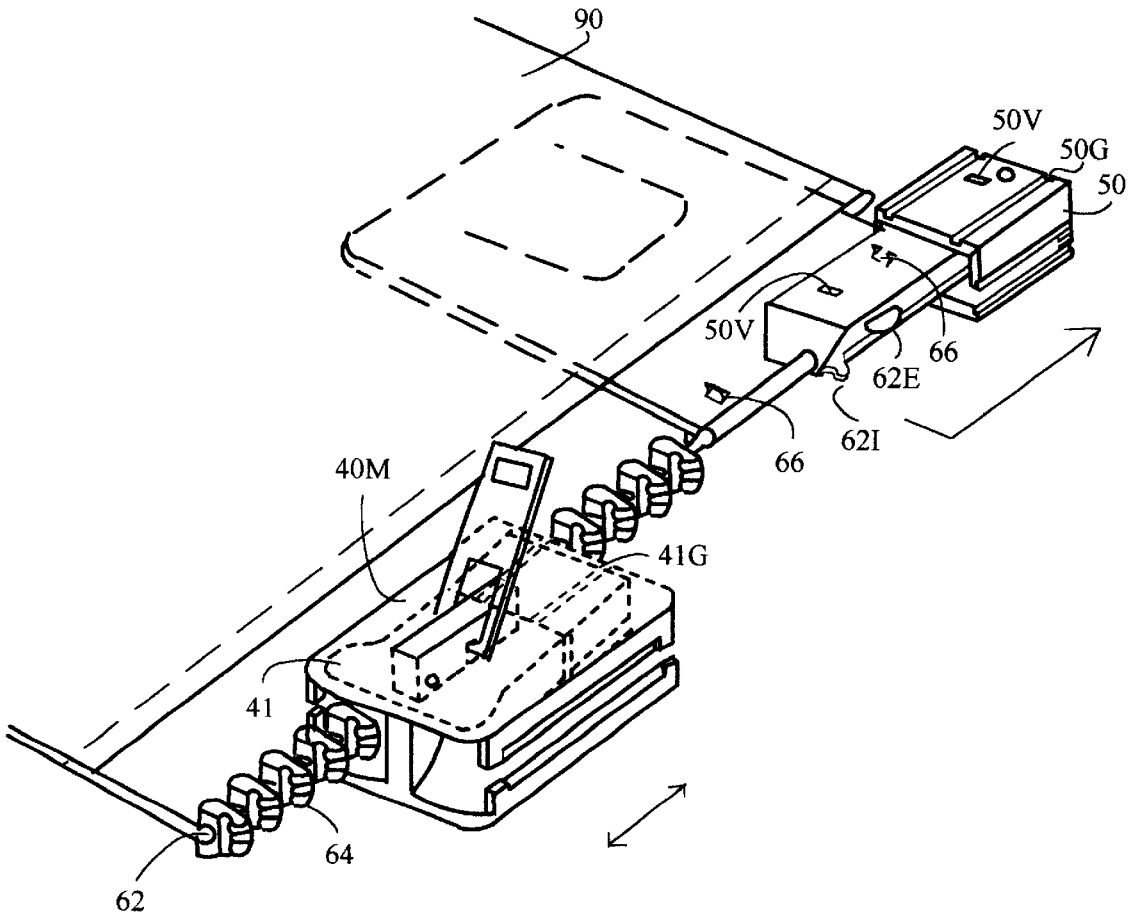
FIG. 9 is a perspective view of the stationary pin and socket box partially removed from the first elongated coupling element.

FIG. 9—Description of Removal of Stationary Pin and Socket Box

FIG. 9 illustrates a fifth of six installation illustrations, showing the removal of stationary pin 49 and box 50 from elongated coupling element 62, as shown by the broken arrow. Slider 41, stationary pin 49 and box 50 or other components (such as a second slider) can be taken off if some part of the installation of the zipper is incorrect, or some portion is broken. The components can also be taken off to correct slider 41, if slider 40 inadvertently slips off teeth 64, during wear of the garment, elongated coupling element 62, or if elongated coupling elements 62 and 76 improperly separate during operation of the zipper.

Figure 10:
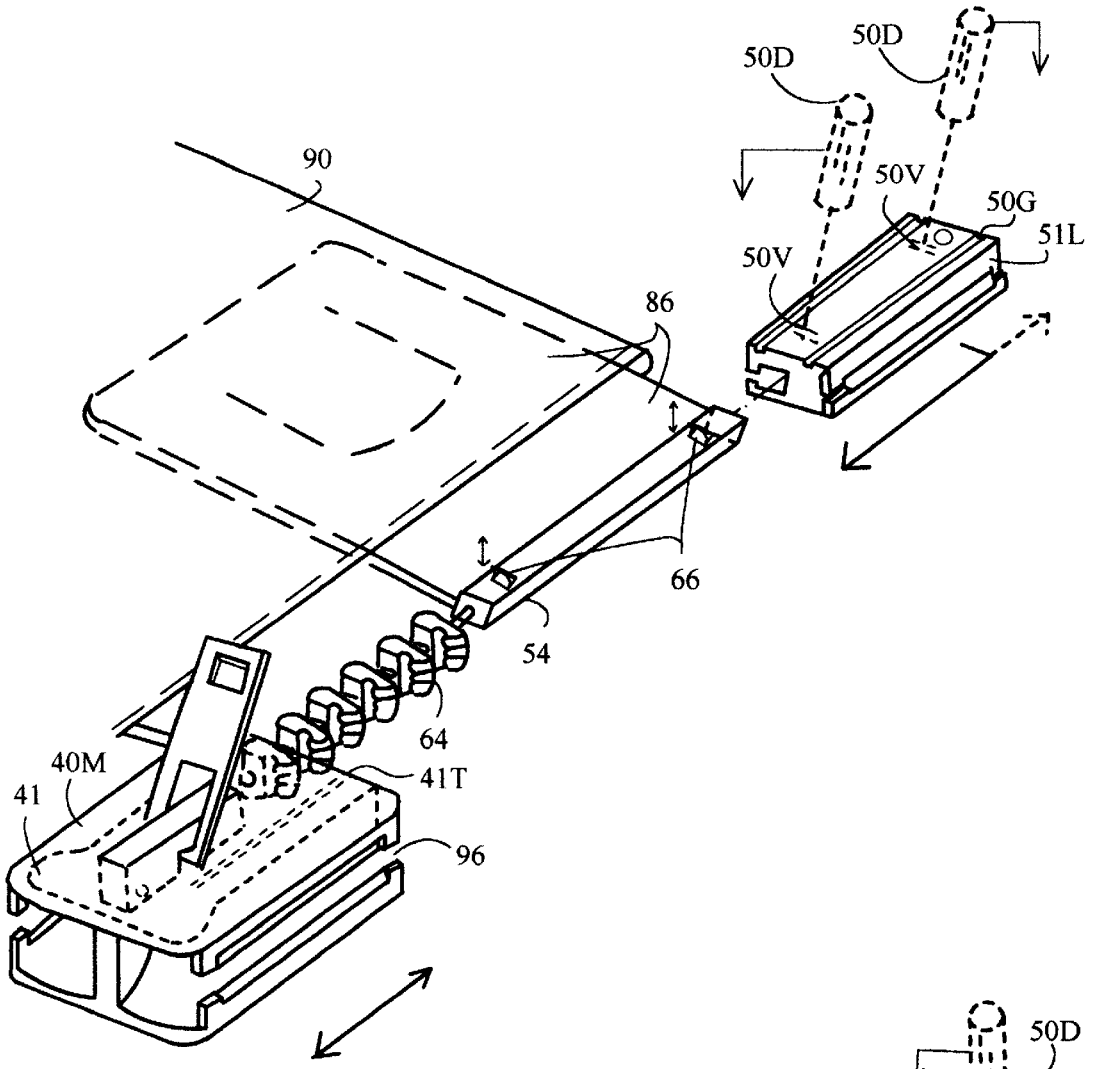
FIG. 10 is a perspective view of a rectangular modification of the locking end of the first elongated coupling element and a full length corresponding socket box.

FIG. 10—Description and Operation of Modification of Elongated Coupling Element

FIG. 10 illustrates the last of six installation illustrations. It shows the removal of a full length socket box 51L. Box 51L is released by the pushing down of two disengaging tools 50D, (tools 50D are shown in dotted lines). The interior of box 50D is rectangular which corresponds to a modification in the shape of the lower tip of elongated coupling element 62. The outside of box 51L has groove 50G to interact and align with tongue 41T on the underside of slider 41. Tip 54 on elongated coupling element 62 is shown with a more rectangular shape rather than cylindrical. Any shape tip can be used, such as triangular, octagonal, wide and flat, etc. A socket member can be releasably installed laterally on a coupling element that has long resilient flanges along the length of the tip. The design of tip 54 is to accommodate the room needed for the placement of releasable locks 66. Box 51L is taken off elongated coupling element 62 in the direction of the dotted arrow. When the correction on coupling elongated coupling element 62 has been made, box 51L can be returned to elongated coupling element 62 as shown by the solid arrow.

Figure 10A:
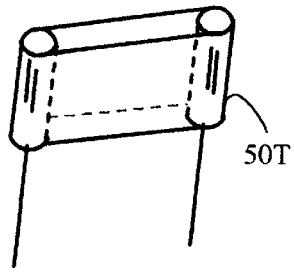
FIG. 10A is a perspective view of a twin detaching tool.

FIG. 10A shows a twin releasing tool 50T, which can be inserted into predetermined, spaced voids 50V to press locks 66 and simultaneously release two locks 66 and unlock box 51L or other components.

Figure 10B:
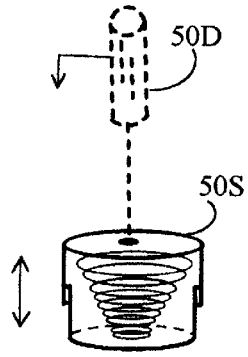
FIG. 10B is an enlarged perspective view of a circular releasing lock and a single detachment tool.

FIG. 10B shows a resilient, button-type, spring lock 50S, that can be used to releasably lock zipper components onto elongated coupling element 62. Releasing tool 50D presses down (broken arrow) upon locks 66 to unlock the components, demonstrated by the solid arrow.

Figure 11:
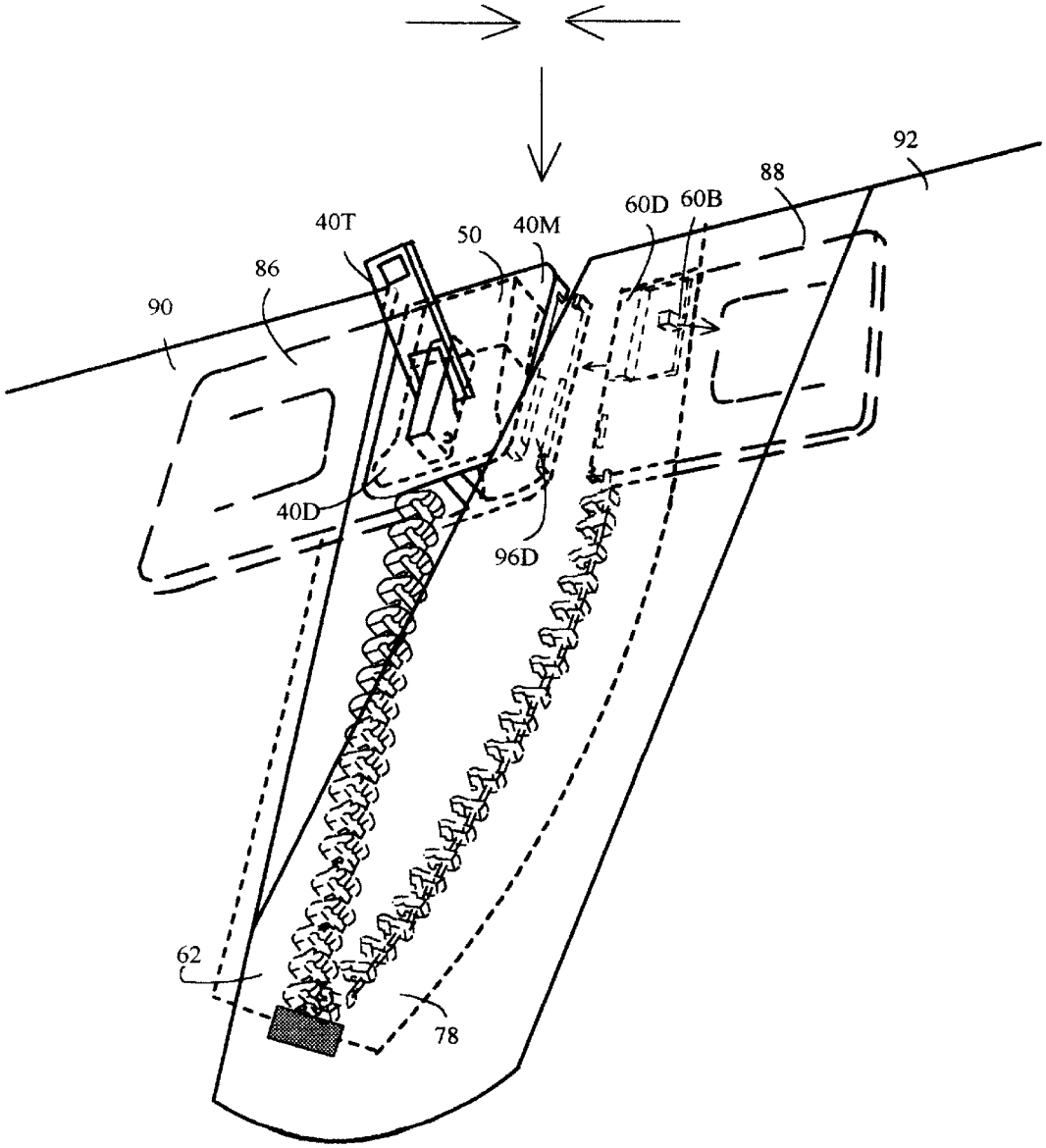
FIG. 11 is a perspective view of a sixth embodiment illustrating an immobile and aligned closure system on a non-separable, hidden zipper.

FIG. 11—Description and Operation of Fifth Embodiment, Immobilized and Aligned Non-Separable Zipper FIG. 11 is a sixth embodiment illustrating an immobile and aligned non-separable zipper, such as those found on the fly of trousers, the front of a jumpsuit, or the waistband of a skirt. Self-locking slider 40 is at the terminal end of the zipper and its movement is arrested. Slider 40, with molding 40M has encompassed box 50, and provided a single arrested differentiated socket 96D, for snap-lock, lateral coupling with a differentiated male interlocking member 60D.

Male member 60D is a modification of member 60 of FIG. 1. The interlocking portion of male member 60D is differentiated. A slender, non-resilient portion on its lower end slides laterally into entrance 94 of slider 40. The upper portion is resilient and slides laterally into a complimentary designed entrance 96D, rebounding and snapping up inside box 50 to lock the ends of elongated coupling elements 62 and 76 together. Intergarment plates 86 and 88 are positioned on elongated coupling elements 62 and 76, respectively, to give the user a rigid, snap-lock buckle to instantly couple the upper end of elongated coupling elements 62 and 76 together.

Male member 60D is inserted laterally into entrance 96D and snap-locks or buckles together the two opposing sides of the garment, shown by the pair of large, horizontal arrows, located above FIG. 11. Slider 40 and molding 40M is then pulled in a downward position, by the user, to close teeth 64, 78 and the remainder of the zipper, shown by the large, vertical arrow. Tab 40T is lifted, along with claw(s) 48 and 48A, and unlocks slider 40. The user then pulls slider 40 by tab 40T downward or in a closing direction, to close the remainder of the zipper. Placing tab 40T in a resting position at the terminal end of the zipper, locks slider 40 in place.

For easy installation, the zipper components for the non-separable zipper are releasably installed on the elongated coupling elements after the elongated coupling elements are sewn on to the garment or article of manufacture. Extra room in the sewing of the zipper, or the concealing fabric, can be allotted for the hiding of slider 40 (and elongated coupling elements) at the terminal end of the zipper. Slider 40/40M can be very small or tapered at the terminal end to promote a neat appearance, as seen from outside of the zipper. The zipper can be installed below the waistband, partially in the waistband, in the waistband, or elsewhere where needed.

To open the garment, the steps are reversed. The zipper is unlocked by lifting and unlocking tab 40T. The user pulls up slider 40 with tab 40T until it encompasses box 50. The user presses a release button 60B on elongated coupling element 62, to unlock the zipper at the initiating end. Pressing button 60B, with a single finger, depresses the resilient portion of member 60D down and away from the locking restraint. Member 60D is released out through entrance 96D in a direction opposite to coupling. Male member 60D can then be removed or is pushed out of entrance 96D with momentum in a lateral direction from slider 40 and box 50, to unlock the zipper.

Figure 12:
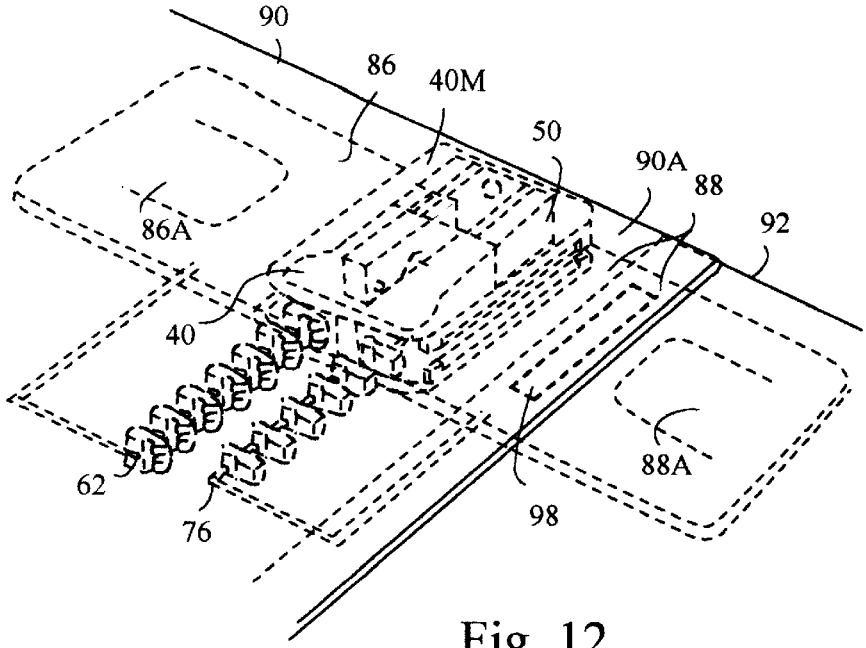
FIG. 12 is a perspective view of a seventh embodiment illustrating a method of waterproofing the immobile and aligned closure system.

FIG. 12—Description of Seventh Embodiment, Hidden, Waterproof and Wind Resistant Immobile and Aligned Closure Systems FIG. 12 is a seventh embodiment illustrating the immobilized and aligned closure system with apparatus to hide and keep the zipper dry and wind resistant. Fabric 90 has been extended and a flap created to cover and hide the zipper. A hook and loop fastener 98, snaps, or other closure, keeps fabric 90 closed over the zipper to keep it dry. This is a simple process which keeps the zipper dry and away from penetrating wind, as well as hiding it.

To further waterproof the closure system, elongated coupling elements 62 and 76 are sprayed, dipped in a waterproof solution or bath, before or after teeth 64 and 78 are affixed. The waterproof solution will cause water to roll off the zipper instead of the elongated coupling elements absorbing the water. The immobile and aligned closure system, when sufficiently treated, is adapted for use in wet suits and in space. The components of this closure system are adaptable for lamination, for waterproofing and wind proofing the zipper. This can done at normal atmospheric pressure or under additional pressure for under water, and space applications. Other water and wind proofing methods can be used.

Figure 13:
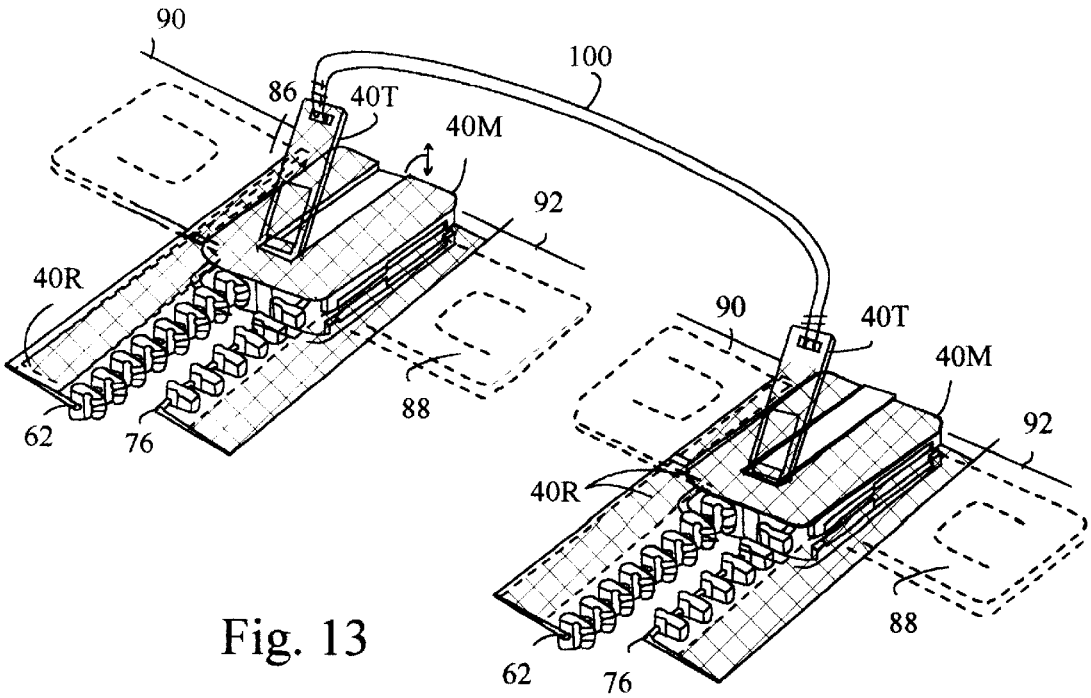
FIG. 13 is a perspective view of an eighth embodiment illustrating a reflective, double zipper with a connective pull strap.

FIG. 13—Description and Operation of Eighth Embodiment, Immobilized and Aligned Double Zipper FIG. 13 is an eighth embodiment showing two immobile and aligned sliders used together to provide a reliable double zipper. A double zipper can be found in articles, such as sports bags that hold large equipment, or computer bags that benefit from having a large, wide opening. A connective zipper pull 100 attached to tab 40T connects slider 40 of one zipper to slider 40 of second zipper. Connective pull 100 is grasped with one hand and pulled in an opening or closing direction. This lifts locking tabs 40T and opens or closes two zippers simultaneously with the effort of opening a single zipper. The center flap of material, between the two zippers can be totally removed and replaced easily, by the operation of the zipper. Slider 40 is adapted to provide a double zipper for fasteners with or without molding 40M.

Reflective material 40R is added to molding 40M and elongated coupling elements 62 and 76. Reflective material 40R is sprayed on, painted on, sewn on or into, adhered temporarily with hook and loop tape, glued on or installed by other means. It reflects light from a car or other source, allowing a motorist to see the user far in advance of when they would notice them, if they did not have the reflective material. Other kinds of material, such as glow-in-the-dark material or added safety features, are easily used as well. Reflective material placed on a separate item that hangs from tab 40T also adds safety protection. Intergarment plates 86 can be removed if desired.

Figure 14A:
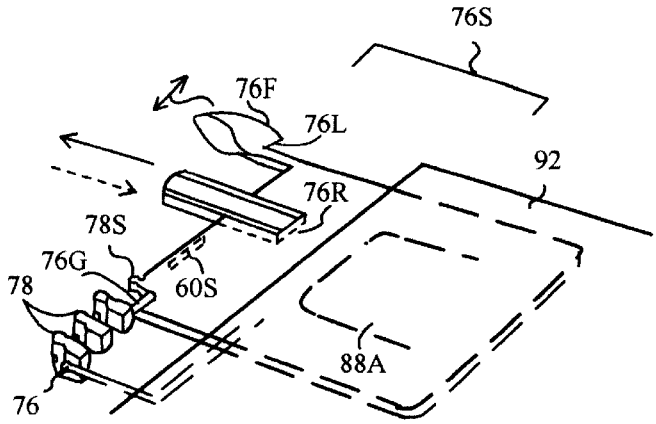
FIG. 14A is a perspective view of a modification of a differentiated male interlocking member.
Figure 14:
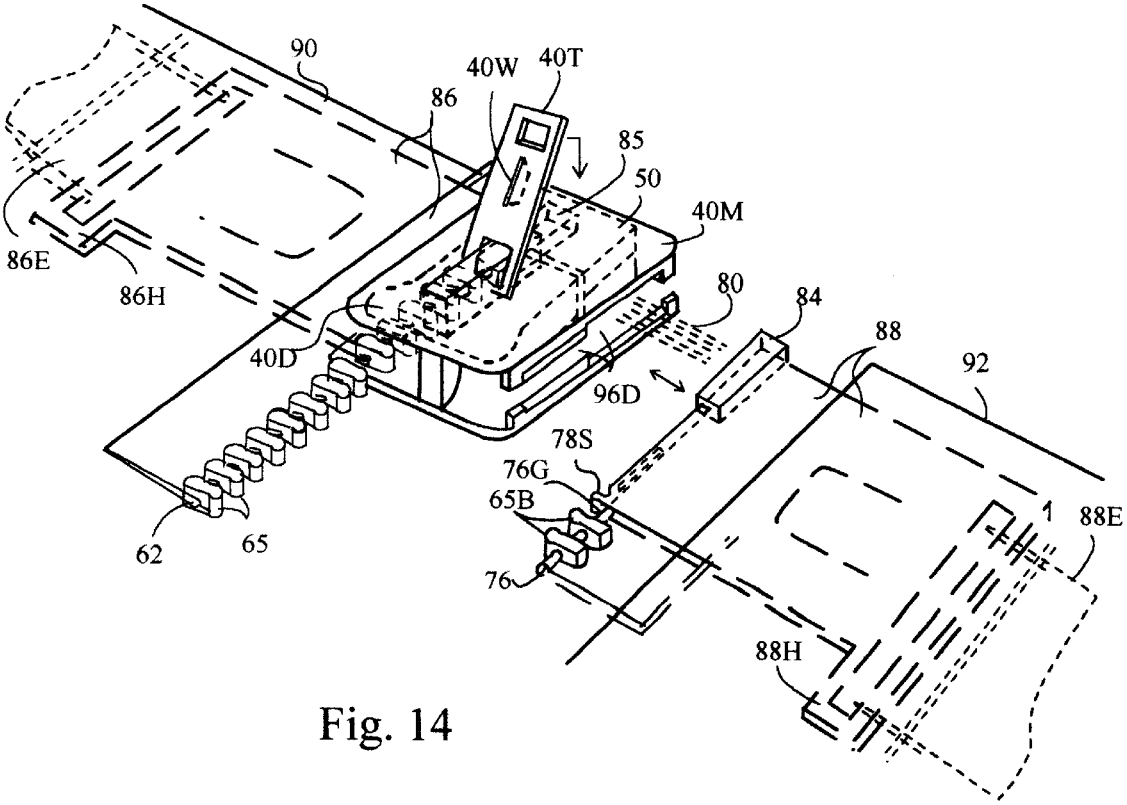
FIG. 14 is a perspective view of a ninth embodiment illustrating a method of magnetic coupling of an immobile and aligned closure system.

FIG. 14—Description of Ninth Embodiment, Magnetically Coupled Slide Fastener with Safety Features FIG. 14 is a ninth embodiment showing an aligned and arrested slider having reliable magnetic coupling. An immobile and aligned entrance 96D is provided for instant movement-free coupling with magnetic male member 84. Intergarment plates 86 and 88, used for stiff and accurate coupling, has strap holders 86H and 88E respectively, to hold elastic, a strap or the like, that goes around a garment in the waistband, etc., to make the jacket fitting at the waist. Pull tab 40T has an uncoupling or dividing wedge 40W, which can be used to uncouple the zipper, for non-emergency everyday use. Magnetic male member 84 is a strong magnet, which is strongly attracted to a corresponding attracted portion, such as metal in, or as stationary pin 85, on elongated coupling element 62. Safety interlocking teeth 65 and 65B close and open elongated coupling elements 62 and 76 along their length.

Teeth 65 and 65B are only shallowly designed and separate under predetermined pressure to open the garment in the event that the garment gets caught in the door of a car, bus, or is caught in other dangerous circumstances. Using safety teeth paired with a magnetically coupled zipper would ideally allow the garment to totally separate, even at the bottom to free a child from injury, possibly from serious injury. This magnetically coupled zipper serves to protect a child in the same manner if applied to fasten the bottom end of the straps of the child's back pack to the pack itself (or other applications). If the straps or the pack becomes entangled or caught in a bus door, the pressure would free the child of the back pack.

FIG. 14—Operation of Magnetically Coupled Slide Fastener

After slider 40D is immobilized and aligned, the user places male magnetic member 84 parallel to and in close proximity to socket 96D. The attractive magnetic force 80 pulls male magnetic member 84 laterally into the guiding socket entrance 96D which initially couples the zipper. Slider 40 is pulled in a closing direction to couple the full length of the zipper. Socket 96D is designed to guide and accept magnetic male member 84. If encompassing molding 40M is not used, member 84 is magnetically pulled into the combined and immobile entrance 94/96A of slider 40 and box 50 (FIG. 3).

To uncouple the zipper, in non-emergency use, the user lowers tab 40T to the initiating end of the zipper. Tab 40T has an uncoupling or dividing wedge 40W. Wedge 40W is located on the under side of tab 40T, corresponding to the portion where male members 84 and female coupling member 85 meet. Tab 40T can lie flat within the surface of slider 40. However, if tab 40T is pressed in further, wedge 40W comes between the two magnetic members 84 and 85, from above (or elsewhere) and separates members 84 and 85 and uncouples the zipper.

The adjoining edges of members 84 and 85 are beveled in a valley shape to guide wedge 40W into position to uncouple members 84 and 85. Wedge 40W also can be used to further immobilize the slider of the immobilized alignment closure system if not pressed all the way down. Depending upon the attractive magnetic force, magnetic male member 84 can also be pulled laterally out of entrance 96D, without wedge 40W, such as in a child's garment. A resilient button or divider that protrudes into housing, or molding, on slider 40 can also be used to uncouple member 84 and 85. Predetermined pressure in an emergency should uncouple the zipper by tearing elongated coupling elements 62 and 76 apart.

FIG. 14A—Differentiated Shoulder-Type Male Flange Interlocking Member

FIG. 14A shows a modification of an releasably interlocking male half-buckle or male interlocking shoulder-type flange member 76S, that has an interlocking flange 76F. Male interlocking flange member 76S couples through a differentiated entrance (not shown), in female half-buckle 104, that is designed to accept male member 76S. Male interlocking flange member 76S releasably couples with the bottom surface of a socket member or a portion of elongated coupling element 76, within female half-buckle 104, as an interlocking rigid buckle, to instantly initially couple the zipper (not shown).

Male interlocking flange member 76S has a guiding rail 76R that guides male member 76S into a corresponding track in female half-buckle 104 for proper alignment for coupling. Resilient locking flange 76F releasably couples with a socket member, such as a socket box, (or coupling element 76), having a corresponding, releasably connectable shoulder type slot, depression, or void (not shown). Male interlocking flange member 76S can be quickly released with a single hand or finger, to uncouple the zipper. Flange 76F can take on any shape such as a sideways "U," "N," or other shape and material that gives it resilience, and have an attached or remotely placed releasing lever or mechanism.

To couple the zipper, the user molding 40M to the initiating end of the zipper, encompassing socket box 50. The user then pushes interlocking male flange member 76S laterally into the opening of differentiated entrance 96D (FIG. 14) in the socket of female half-buckle 104. While guiding rail 76R is automatically guided into a corresponding track inside socket 104, resilient flange 76F simultaneously compresses inward, or upward, and pushes over the front edge of the retaining edge in the shoulder slot in the bottom of the socket box, or other place.

When it reaches the void of the retaining shoulder slot, interlocking flange 76F drops into the slot and resumes its pre-deformed shape, audibly snap-locking coupling edge 76L with the rim, or retaining surface of the shoulder slot, initially coupling the zipper together. The lower surface of flange 76F, partially protrudes through the shoulder slot in the bottom of the socket box, or below female half-buckle 104, when it is coupled, for uncoupling, and can be felt as a bulge. Elongated coupling element 76 with teeth 78 slide over the socket, aided by guiding edge 76G. Female half-buckle 104 is drawn to close the zipper along its length, leaving socket box 50 and male interlocking flange member 76S at the initial end of the zipper.

Locking edge 76L of flange 76F can be an indented retaining surface to lock with the retaining surface, or thickness of the shoulder slot opening, such as 76L, shown, or it can be a softer more curved edge, locked by the pressure of flange 76F, on the shoulder slot opening, or void. These are akin to traditional quick release, two piece, laterally coupled buckles, usually having two male interlocking flanges.

To uncouple the zipper, encompassing molding 40M is drawn to its initial position, again encompassing socket box 50. The user then pushes the bulge or protruding lower surface of flange 76F back inside the socket box, upwards, inside the body of female half-buckle 104 with a single finger. This quickly releases the buckle and opens the garment. Pressing releasing flange 76F inward can project male coupling member 76S laterally, clearly out of female half-buckle 104 with some momentum, immediately uncoupling the zipper. An attached or remote release button or lever can also be used to release the locking edge or coupling of this buckle-started closure system, especially if the male interlocking member is shaped like a sideways U or N, above.

Conclusions, Ramifications and Scope

The reader will see that I have provided a slider for a slide fastener, or zipper, which arrests is own movement in order to provide an immobile, aligned, and easily coupled socket. A rigid snap-together buckle placed on the initiating ends of the zipper instantly couple the zipper, and the female buckle-half, with its slider within, closes the zipper along its length. This is a new and beneficial arrangement. It is a simple and economical way to provide dependable coupling, especially for those in a hurry, the very young, or those who may have a disability. This method and apparatus uses less effort than a traditional zipper, yet it readily provides more convenience and reliability than the traditional zipper.

In a traditional zipper, the user already uses the zipper pull to move the slider along the elongated coupling element, and lets it go when they have moved the slider to where they want it to be. Using the same amount of effort and a self-locking slider, the user can easily arrest the movement of the slider and instantaneously couple the zipper with a quick snap of the two sides of the zipper. The zipper can quickly be coupled laterally, just like a rigid, quick-release, plastic buckle, which is much easier to couple than trying to thread a male pin through a moving slider and into a small socket box (or two sliders) whose entrance one can not see.

While the above description contains many specificities these should not be considered limiting since many variations and ramifications will be apparent.

This versatile zipper can be installed in a factory setting using an extra heat sealing process to seal on the socket box and stationary pin, after the zipper has been inspected and cleared for permanent installation, if desired. A socket member can be permanently attached afterwards with pressure or heating sealing or melting the components together. A socket member can also be released using a resilient release button that is easily accessible to the owner of the garment, rather than using a more inaccessible release mechanism, as illustrated. Any suitable materials can be used including rubber, plastic, metal, and the like.

The features illustrated in the drawings may be combined for different and new applications or embodiments, according to this closure system, or other methods can be used.

A resilient mechanism in the socket member can be used to snap-lock on the components for installation of the components after sewing of the elongated coupling elements. The stationary pin and socket box can be snap-locked laterally, or horizontally, onto an elongated coupling element. A stationary pin or terminal end of an elongated coupling element can be used as a socket member to streamline the design of the closure system. A self-locking slider that does not have encompassing or non-encompassing molding, can encompass a socket member (FIG. 2) to streamline the design and provide a more compact coupling entrance.

This zipper can also be sold separately at sewing stores, with all its components, for easy, at home installation, without hindrance of the components being in the way. Often hobbyists, dress makers, plush toy makers, and the like, need to install zippers at home. This will enable the home sewer to easily sew on the elongated coupling elements, without the zipper head and socket box in the way, resulting in a neater, more solid installation, less frustration and a lesser number of machinery parts.

Combining the safety of a releasing zipper, such as that found in Cullum, above, to an easy to install, magnetically coupled (or other), reflective, immobile and aligned closure system would provide a safer, more easily coupled zipper, especially for children. Combining releasing zipper teeth with magnetic lateral coupling, ensures that the zipper totally separates under pressure, for a completely releasing, safer zipper for children.

Zipper teeth designed with a thin extension of their upper plastic surface, that reaches slightly over (or under—or both) the gap between interengaging teeth and into a depression in the complimentary teeth, covers the gap between the interlocking teeth to keep moisture out. The immobilized and aligned zipper systems can operate with any interlocking configuration or contours of teeth, coiled zippers, profile rib closures, and the like.

Arrested and aligned sliders and closure systems can be used anywhere zippers are used, including metal and plastic zippers, coiled zippers, two-way zippers, reversible zippers for reversible garments that can be worn on either side, and in profile and groove plastic zippers, such as those used in storage bags and the like. Immobilized, snap-lock buckled sliders can be placed back to back so the sliders can be locked together with a separate key or combination lock, to lock luggage. Immobilized closure systems can be used for zipping off the lower end of pants to make the long pants into shorts and for zipping off sleeves to make a vest. They can attach liners into coats, hoods onto jackets, zip pages or pencil cases into a binder, attach filters onto furnaces, connect one IDE computer connector cable to another cable along its length, used on packaging, and have innumerable other uses.

A series of small, or short buckle initiated, snap-lock zippers can be placed one above the other, such as a series of buttons on a coat, to create a new style of zipper. All members of the closure system can have different colors, or decorated in a manner that shows how it should be used, especially for children. They can be used in combination with hook and loop tape, and other fasteners to make a multifaceted closure device. Additional buckles and zippers can be placed on a garment or article to close pockets, flaps of material, add items, or the like.

Two independent arrested and aligned slide fasteners, or double zippers, with slider 40 can be used to insert more material to a surface, such as adding an additional segment of artificial turf to a stadium playing surface or arena. Double zippers with the connective pull tab 100 can be used to interchange different colors of material where desired, and make articles larger or smaller, wider or narrower, such as for a gusset or making draperies wider, adding different patterns, adding restraining material to hold groceries in the trunk of a car, etc., as well as openings of luggage and containers.

Arrested and aligned sliders and closure systems can be used to instantly snap alternate ends of material together, such as opening two sleeping bags and snapping them together to make one larger sleeping bag.

Having a large buckle to initially attach the ends of a garment together and attaching large tabs and grasping members that hang from the pull tabs, enables skiers and working users to couple and uncouple the arrested and aligned, buckle-started zipper easily, without removing their gloves. Self-locking sliders that provide immobile and aligned sockets for coupling can encompass a socket member, stationary pin or elongated coupling element. Stationary pins, socket members, or other components can be made thicker in the back, or other places to accommodate interlocking members, etc., in order to keep the slide fastener narrower and streamlined for operation.

Significantly wider elongated coupling elements can be used to allow a wider two-piece interlocking buckle to be used, permitting a slider with oversized molding to slide without encumbrance, along the elongated coupling elements. Also the fabric along the edge of the elongated coupling elements can be sewn down in place so it will not impede the movement of the slider. Encompassing or non-encompassing molding can provide tapering and a guiding entrance, and an entrance with the equivalent of a single thickness. Molding can provide guiding interlocking tongue and groove members, buttons, snaps, or the like, for positioning and retention. Molding and/or male interlocking members can provide a plurality of strap holders to accommodate other straps to be used with additional harnessing, closure systems, or the like. The socket member can be totally eliminated and the two elongated coupling elements can resiliently snap together, with the lengths being closed by the slider (FIG. 2).

The zipper can also be uncoupled by moving the slider all the way down to the initiating end, where the dividing triangle of the slider, inside the slider, is designed to (or other element) push down on a resilient flange or activating button and instantly and automatically uncouple the zipper. The slider is kept on the elongated coupling element by shaping the elongated coupling element wider at the terminal tip, creating an abutment, or other method, or kept above the position of the locking terminal ends by shaping of an interlocking tooth.

A resilient wire (or other method) will also force tab 40T down into a flush position, if applied to tab holder 44 and tab 40T. A smooth upper plate, or visible plate, on the female half-buckle provides an aesthetic appearance. Claw 46 is adapted to penetrate elongated coupling element 62, a void 50V or depression in box 50, stationary pin 52, a space in between two teeth 64, 78, the fabric of elongated coupling element 62 or elsewhere. When 40T is lifted to pull slider 40, the lower end of 40T lifts tab holder 44 and its attached claw 46. This releases the lock on slider 40, so the elongated coupling elements can be closed or opened. More than one claw 46 can be used to penetrate single or multiple sites simultaneously, to solely arrest all movement of slider 40.

Coupling and releasing mechanisms can be placed in any location and on either elongated coupling element, including the bottom (such as male interlocking member 76F—FIG. 14A) or on the edges, such as the quick-release plastic snap-lock buckles on a backpack, car seat, or seat belt on a stroller. A lock can be placed on the terminal end of a zipper, such as if the closure system is used to restrain a toddler or infant, as those used in a car seats, strollers, or high chair harnesses.

The aligned and arrested closure system can also be coupled by pressing the interlocking male half-buckle into the top or bottom surface of the female half-buckle and snapping it shut.

A resilient interlocking male member can have many modes of operation as well. It can be totally resilient, have resilient parts combined with non-resilient parts, have manually operated parts, or be totally non-resilient, for use with a spring-lock assembly, etc. The spring-lock assembly can have other locking edges and be made in different ways with different engaging and releasing mechanisms. Spring-lock assembly 50L can be located on either elongated coupling element 62, 76.

A releasing button can be placed under resilient material, such as a pliant rubber or a pliant plastic covering on the slider's upper plate, or other location, so the releasing button would seem to be invisible (except for a designated marking if desired). When the pliant covering is pushed down, over the position of the releasing button, the zipper is uncoupled. This is akin to the touch pads of many appliances of today, including a television remote control device or microwave activating touch panel. A release button can also be activated by pushing the slider tab down firmly in the upper plate of the slider, or pulling the slider down if it has a specially designed unlocking projection inside, to activate a release button at the terminal end.

The dead person's lock can be designed differently than as illustrated. The locking member of the dead person's lock can be mounted perpendicularly to the resilient mechanism. The dead person's locking member can be activated with a resilient button on the top of lock 42L where the top of lock 42L has a lip for the under placement of two fingers, so that the activating finger has other fingers to push against. The dead person's lock can be operated by other means, such as by a corkscrew mechanism that lifts and lowers the locking mechanism or by the use of coiled springs, resilient plastic, metals or the like. Dead person's locking tabs can be combined with a plurality of other self-locking tabs or sliders in a single closure system.

The dead person's locking member can be located off-center, so it will be located above the teeth of elongated coupling element 62, rather than being located directly in the center. The locking device inside the dead person's locking tab can be off-center inside, instead, so that the locking tab can be located in the center of the slider. Locking devices can lock non-consecutive interlocking teeth. The locking mechanism can be activated by pushing in resilient flanges on the sides of the molding to unlock and slide the slider and molding.

The immobile and aligned closure systems can be used for separable zippers, weather resistant zippers, safety zippers, non-separable zippers, two-way zippers for reaching an inner garment, reversible zippers for operation on both sides of a garment, etc., double and multiple zippers. They can be laterally and vertically coupled. The aligned and arrested system can be designed to be at an angle for the comfort of the user's wrists or the like. They can be used on, garments, accessories, CD binders, footwear, toys, housewares, bedding, carpeting, camping and sports equipment and surfaces, harnesses that have a plurality of closure systems and male interlocking members, transportation, space travel or preparation thereof, and medical applications. They can be used in an inverted position, such as the non-separable zipper in FIG. 10, or used in a conventional position on a non-separable zipper, with the socket member at the bottom. They can be of any material or color, including prism, glitter, transparent, holographic, or lit from the inside with a small light bulb, etc. This closure system can be used intentionally as a disposable fastener that is used to pair items together with a temporary or non-durable adhesive for display or packaging and then peeled off and discarded at home.

The immobile and aligned closure system can be used for profile and groove closures on plastic storage bags, plastic sheeting, and the like. They can have releasable connectable additions, such as snap-lock key holders, whistle holders, small flashlights, swivel and/or hinged holders, luggage identification tags, trinkets, novelties, and the like, that snap onto the zipper pull tab or socket member. Attachments can be additional two piece rigid plastic buckles, or combined with a male interlocking member situated on the closure system, or vise-versa. Interlocking zipper teeth can be of any height, shape, or dimension or a combination thereof, to allow for a sufficient lateral opening to the slider and for proper operation of the closure system.

The immobile and aligned closure systems can be used for tiny applications, such as on pieces of jewelry. The immobile and aligned closure systems can be used for very large uses, such as on industrial machinery belts that hold an extensive amount of weight. They can be used in specialized industries, such as for stadium use and astronauts, as above, divers, airlines, and construction use.

Molding can extend from the base of the slider and be inserted in the upper end of the socket box to house or bridge the members together, or molding can extend from other coupling members, for this purpose, such as extending upward from a socket member to bridge or encompass the slider. Molding can provide suitable entrances of any shape to enhance dependable coupling of the zipper. Molding, sliders, and other components can provide guiding surfaces for smooth bridging, alignment and for operation of the zipper. A plurality of zippers can be placed back to back or in any position to provide dependable coupling for new uses.

Differentiated male interlocking members can always be used to couple through differentiated sockets, designed to accommodate their design. A significantly wider portion of the differentiated male interlocking member can be provided for locking with a socket member, or the like, while a narrower portion of the male interlocking member is provided for slipping through the open side of the sliding zipper head and locking within the sliding zipper head. A socket member can be considerably wider, thicker, etc. to accommodate a much wider male interlocking portion or member. This wider socket member or portion of the socket member and the interlocked male member (when coupled) can be partially or wholly incorporated into the fabric of a garment, or housed in the intergarment plate, or other suitable area, while coupled, so the socket member and the slider can magically seem to have the same size, (and the male member sees to disappear into a socket that is too small for it) when viewed from the outside of the garment (FIG. 1G). This housing can be used for any of the coupling methods, or on either coupling element, as needed. A much wider or bigger male interlocking member and socket member gives the user more surface area for holding and easier guiding of the male member into the socket for coupling.

The interlocking snap-lock buckle preferably has a smooth or plane surface,(but is not essential) to resemble a regular, two-piece, snap-lock buckle. The buckle can have any shape including triangular, etc., or having concave, or convex upper and lower plates, sides, etc, thumb recesses or twisted and shaped pull tabs to suit the fingers. The buckle, pull tabs or operating surfaces can have a rubber surface or a "soft-touch" for the comfort of the user.

The pull tab, tab holder, locking projections, etc. are preferably inset in the molding to provide this aesthetic appearance. The male side of the zipper can have encompassing molding, or non-encompassing molding for aesthetic appearance or for dependable operation of the zipper, or the stiff intergarment plate and male interlocking member can be considered molding. The zipper can be snap-locked from the side and released through the top or can be locked from the top and released through the side of the slider. Components can be incorporated near the coupling site to efficiently and quickly initiate the engagement of the zipper teeth, such as space bar 76G, tooth 78S and slot 60S.

Male and female interlocking members and releasing mechanisms can be resilient flanges, etc., non-resilient members combined with resilient members, non-resilient members, or situated on resilient flanges, resilient in different or opposite directions or otherwise, or located elsewhere.

Resilient flanges also includes flanges that operate by being pushed into a wider position or angle by an interlocking member, which locks by falling back down into a restricting hollow or void in the interlocking member. An example of this is when a male interlocking member is pushed against a resilient hinged panel in a female socket member, during coupling, and the panel then drops down into a recess in the male interlocking member behind a locking front edge, when it is pushed all the way into the socket. This buckle is unlocked by a releasing member (button, etc.) pushing the flange, or hinged panel in the female socket, in a wider angle again and out of the restricting recess or locking edge in the male interlocking member, uncoupling the buckle. Non-resilient interlocking male members can have depressions, voids, tapered, cut or shaped edges or designs to interlock with resilient female members to couple and uncouple the zipper.

A safety zipper can be rounded, tapered or designed to release more easily, such as curving or tapering the entrance of the magnetic immobilized and aligned zipper socket so the male interlocking member can be pulled out at an angle without catching on something, such as fireman's corners.

Interlocking sites can be placed anywhere on the male or female members. Releasing members can also be placed anywhere that promotes a dependable, easily operated, and aesthetic zipper, including inside the sliding zipper head, the sides of the buckle or remote areas, such as by pressing a zipper tab, a portion of the intergarment plate, etc., or by tugging on a zipper pull tab that can release the zipper. A user can operate the zipper from either side of a reversible garment, with a reversible buckle that couples and uncouples the garment on either side. A female socket or buckle-half can couple with a plurality of male interlocking members. These male interlocking members can each have strap holder(s) for creating dependable harnesses, as above. All strap holders can have gripping members to immobilize and adjust the straps.

The molding, or pull tabs on the female half-buckle (or other area), can house additional features, such as a garage door opener, a light switch, car/trunk entry, a working miniature sized computer or digital game piece for a child or a regular timepiece. This timepiece, etc., can be analog, or digital, etc., and can be orientated so that the wearer can clearly read the time (or play the game). These additional features can also be hung from the slider pull tab. The molding can be illustrated with decorations or instructions on how to operate the zipper. Parts can have recessed and/or overlapping portions to fit together to provide planar surfaces. Overlapping material can provide hidden zippers. All parts, shown and not shown, are designed and shaped to enhance dependable performance, convenience for the user, and an aesthetic appearance of the aligned and immobile closure systems, according to this invention.

Locking devices includes portions, components or members that utilize gravity, pressure, or friction to immobilize and align the closure system for coupling. An example of friction is using rubber projections or coatings that are pushed against other designated areas or other rubber portions to immobilize the zipper head, or rubber tongues and grooves, or the like. The zipper head can also be immobilized by allowing gravity to drop the sliding zipper head, situated on an elongated coupling element and equipped with a cogwheel or cog formation that juts in between zipper teeth when dropped on specially formed teeth on the initiating end of the coupling element to arrest movement and align the slider. Springs and resilience that work in connection with clamps to grab zipper teeth, such as from the front and the back of the teeth, or other components or portions can be used. Other methods can also be used. Features not in conflict can be used to improve my previous patent, above.

Accordingly, the full scope of the invention should be determined not by the embodiments illustrated, but by the appended claims and their legal equivalents.

What is claimed is:

1. An immobile and aligned closure system, comprising:

(a) two elongated coupling elements, each having an inner edge and an opposite outer edge, said two elongated coupling elements being affixable to respective lengths of material, said two elongated coupling elements each having a row or chain of interengaging and locking members mounted on and along said inner edge, said two elongated coupling elements being lockable to each other for coupling and closing and alternately uncoupling and opening said two elongated coupling elements, (b) a self-locking sliding zipper head, situated on one of said two elongated coupling elements and said two rows or chains for locking and closing and alternately unlocking and opening said two elongated coupling elements and said two rows or chains along their length, said self-locking sliding zipper head comprises means for arresting a) lateral movement of said self-locking sliding zipper head perpendicular to said rows or chains, b) anterior-posterior movement of said self-locking sliding zipper head on said rows or chains, and c) vertical movement of said self-locking sliding zipper head along said rows or chains, said self-locking sliding zipper head comprises a locking projection and means for solely providing an immobile and aligned coupling socket for instant, initial coupling of said closure system, said initial coupling being the first attachment of said two elongated coupling elements and said two rows or chains to each other at an initiating end of said two rows or chains for operation of said closure system, said self-locking sliding zipper head being a sole arresting member and comprising means for solely providing said immobile and aligned coupling socket for initial coupling and operation of said closure system, wherein said immobile and aligned closure system comprises a minimum number of components and means for providing a safety, laterally coupled, immobile and aligned closure system adapted for releasing a garment or article of manufacture under a predetermined pressure resulting in less injury to a wearer, and (c) a male interlocking member, situated on the other of said two rows or chains for initially coupling and uncoupling with said self-locking sliding zipper head and said closure system, whereby a self-locking sliding zipper head can solely provide an initial coupling socket for instant snap-lock lateral and traditional coupling of a slide fastener.

2. The immobile and aligned closure system of claim 1 wherein said closure system is adapted for operating with three main components comprising a) two interlocking elongated coupling elements adapted to directly couple each other, and b) a self-locking sliding zipper head being adapted to align and arrest said lateral, anterior-posterior and vertical movement of said self-locking sliding zipper for providing an immobile aligned socket for dependable initial coupling.

3. The immobile and aligned closure system of claim 1 wherein said safety laterally coupled immobile and aligned closure system comprises a predetermined pressure release for releasing a garment or article of manufacture when a wearer is caught in a dangerous circumstance for freeing said wearer from said garment or article resulting in less injury to said wearer, wherein said safety laterally coupled immobile and aligned closure system is a magnetically coupled closure system.

4. The immobile and aligned closure system of claim 1 wherein said self-locking sliding zipper head comprises a dead person's lock having a locking projection and means for providing an aligned and immobile socket for dependable lateral and traditional initial coupling of said closure system, said dead person's lock maintains said self-locking sliding zipper head in a locked position until it is purposely unlocked, wherein an interlocking site is adapted to be placed anywhere on a male or female member.

5. The immobile and aligned closure system of claim 1, further including a socket member on one of said two rows or chains for coupling and uncoupling said closure system and for operation of said closure system.

6. The immobile and aligned closure system of claim 1, further including a wide male interlocking member, said wide male interlocking member being wider than said self-locking sliding zipper head, said wide male interlocking member is adapted for initially coupling and uncoupling said closure system, said wide male interlocking member being situated within a housing in an intergarment plate at the initiating end of said closure system when coupled, said housing comprises means for using a plurality of coupling methods for initially coupling said closure system, said wide male interlocking member comprises more surface area for holding and easier guiding of said wide male interlocking member into a socket for coupling, said wide male interlocking member being easier to couple than a more narrow interlocking member.

7. The immobile and aligned closure system of claim 1, further including means for releasably installing said closure system, without any of the components of said closure system hindering its installation.

8. The immobile and aligned closure system of claim 1, further including encompassing molding on said self-locking sliding zipper head and a socket member, said encompassing molding is adapted to encompass another member of said closure system, said encompassing molding is adapted for providing a) a unified and aligned entrance for instant coupling, b) means for providing an aesthetic appearance, c) a guiding entrance for coupling, d) a differentiated entrance having wide and narrower portions allowing for lateral coupling with a differentiated male interlocking member having wide and narrow portions, e) means for softly coating touchable areas for the comfort of the user, f) means for eliminating movement in a fabric elongated coupling element during initial coupling, since components are located on a fabric elongated coupling element, which can move.

9. The immobile and aligned closure system of claim 1, further including a plurality of intergarment plates, situated on respective ends of said two elongated coupling elements and said rows or chains, wherein said plurality of intergarment plates are adapted to comprise a housing for coupling and uncoupling with a wide male interlocking member for operation of said closure system, said housing comprising means for use of a plurality of coupling methods for initially coupling said closure system.

10. The immobile and aligned closure system of claim 1, further including a non-encompassing molding on said self-locking sliding zipper head and a socket member for providing a unified socket entrance through said members for initial coupling of said closure system, said non-encompassing molding extends beyond said self-locking sliding zipper head and said socket member for providing a streamlined and unified aligned guiding socket entrance for coupling.

11. The immobile and aligned closure system of claim 1, further including a shoulder-type flange male interlocking member for releasably coupling with a female half-buckle on said respective edges of said two elongated elements and said rows or chains of interlocking elements, said coupling being an interlocking rigid male and female snap-lock buckle for initial coupling of said elongated coupling elements and said closure system and for operation of said closure system, wherein said shoulder-type male interlocking member is adapted to be uncoupled with momentum.

12. The immobile and aligned closure system of claim 1, further including a rigid, male and female snap-lock interlocking buckle, situated on the respective ends of said two elongated coupling elements and said rows or chains of interengaging and locking members for instant initial coupling and uncoupling of said two elongated coupling elements for operation of said closure system, wherein said rigid, snap-lock buckle comprises softly coated touchable areas for the comfort of the user.

13. The closure system of claim 1, further including means for providing a water resistant closure system.

14. The closure system of claim 1, further including a plurality of safety features on said closure system comprising a) interlocking zipper teeth being releasable from each other under predetermined pressure, b) reflective, lit, and glow-in-the-dark material for the user's safety, c) releasable initial coupling members, d) fireman's corners, said fireman's corners on members of said closure system angle corners of components and are adapted to give way under predetermined pressure for freeing a user from a garment or article of manufacture.

15. An immobile and aligned closure system comprising:

(a) two elongated coupling elements, each having an inner edge and an opposite outer edge, said two elongated coupling elements being affixable to respective lengths of material, said two elongated coupling elements each having a row or chain of interengaging and locking members mounted on and along said inner edge, said two elongated coupling elements being lockable to each other for coupling and closing and alternately uncoupling and opening said two elongated coupling elements, (b) a self-locking sliding zipper head, slidably connected to one of said two elongated coupling elements for coupling and uncoupling said two elongated coupling elements along their lengths, said self-locking sliding zipper head has a locking projection and is adapted to solely arrest a) lateral movement of said self-locking sliding zipper head perpendicular to said rows or chains, b) anterior-posterior movement of said self-locking sliding zipper head on said rows or chains, and c) vertical movement of said self-locking sliding zipper head along said rows or chains, said self-locking sliding zipper head being a sole arresting member adapted for solely providing said immobile and aligned coupling socket for initial coupling and operation of said closure system, and (c) a wide interlocking male member, situated on the other of said two elongated coupling elements, said wide interlocking male member being wider than said self-locking sliding zipper head, said wide interlocking male member is adapted for coupling and uncoupling said closure system, said wide interlocking male member being partially situated in a housing in an intergarment plate while coupled, said housing comprising means for use of a plurality of coupling methods for initially coupling said closure system, said intergarment plate being situated at the initiating end of said one of said two elongated coupling elements for operation of said closure system, said wide interlocking male member provides the user more surface area for holding and easier guiding of said wide interlocking male member into said socket for coupling, and (d) a socket member on one of said two rows or chains for locking with said wide interlocking male member and for operation of said closure system.

16. The immobile and aligned closure system of claim 15, further including a rigid, intergarment plate on one of said two elongated coupling elements for dependable initial coupling of said closure system, said intergarment plate being situated at the initiating end of said one of said two elongated coupling elements for operation of said closure system, said intergarment plate comprising a) a holder for holding a length of material, b) means for gripping said length of material for immobilizing and adjusting said material, c) means for releasing said closure system, d) housing for members comprising 1) a wide interlocking male member being wider than said self-locking sliding zipper head, said wide interlocking male member provides the user more surface area for holding and easier guiding of said wide interlocking male member into a socket for initial coupling, and 2) a spring-lock assembly for operation of said closure system, said housing comprising means for use of a plurality of coupling methods for initially coupling said closure system.

17. The immobile and aligned closure system of claim 13, further including means for releasably installing said closure system comprising a) releasably locking components for installing, uninstalling and reinstalling said closure system without hindrance of having to sew around bulky components and to correct inaccurate installation and mishap, b) means for providing permanent installation after said closure system has been inspected, c) means for installing said closure system in a factory, d) means for installing said closure system in the home including plurality of tools, and instructions, and e) means for temporary use and for display and packaging.

18. The immobile and aligned closure system of claim 15, further including a rigid, male and female snap-lock interlocking buckle, situated on the respective ends of said two elongated coupling elements and said rows or chains of interengaging and locking members for instant initial coupling and uncoupling of said two elongated coupling elements for operation of said closure system, wherein said rigid, snap-lock interlocking buckle comprises means for softly coating touchable areas for the comfort of the user, wherein an interlocking site is adapted for placement anywhere on the male or female members.

19. An immobile and aligned closure system comprising:

(a) two elongated coupling elements, each having an inner edge and an opposite outer edge, said two elongated coupling elements being affixable to respective lengths of material, said two elongated coupling elements each having a row or chain of interengaging and locking members mounted on and along said inner edge, said two elongated coupling elements being lockable to each other for coupling and closing and alternately uncoupling and opening said two elongated coupling elements, (b) a self-locking sliding zipper head, slidably connected to one of said two elongated coupling elements for coupling and uncoupling said two elongated coupling elements along their lengths, said self-locking sliding zipper head has a locking projection and is adapted to solely arrest a) lateral movement of said self-locking sliding zipper head perpendicular to said rows or chains, b) anterior-posterior movement of said self-locking sliding zipper head on said rows or chains, and c) vertical movement of said self-locking sliding zipper head along said rows or chains, said self-locking sliding zipper head being a sole arresting member adapted for solely providing said immobile and aligned coupling socket for initial coupling and operation of said closure system, and (c) means for releasably installing said closure system comprising a) releasably locking components for installing, uninstalling and reinstalling said closure system without hindrance of having to sew around bulky components and to correct inaccurate installation and mishap, b) means for providing permanent installation after said closure system has been inspected, c) means for installing said closure system in a factory, d) means for installing said closure system in the home including plurality of tools, and instructions, and e) means for temporary use and for display and packaging.

(d) a male interlocking member, situated on the other of said two rows or chains for coupling and uncoupling with said self-locking sliding zipper head and said closure system for operation of said closure system.

20. A method of providing an immobile and aligned closure system comprising:

(a) providing two elongated coupling elements, each having an inner edge and an opposite outer edge, said two elongated coupling elements being affixable to respective lengths of material, said two elongated coupling elements each having a row or chains of interengaging and locking members mounted on and along said inner edge, said two elongated coupling elements being lockable to each other for coupling and closing and alternately uncoupling and opening said two elongated coupling elements along said lengths, (b) providing a self-locking sliding zipper head, slidably connected to one of said two elongated coupling elements for coupling and uncoupling said two elongated coupling elements along their lengths, said self-locking sliding zipper head has a locking projection and means for solely arresting a) lateral movement of said self-locking sliding zipper head perpendicular to said rows or chains, b) anterior-posterior movement of said self-locking sliding zipper head on said rows or chains, and c) vertical movement of said self-locking sliding zipper head along said rows or chains, said self-locking sliding zipper head being a sole arresting member adapted for solely providing said immobile and aligned coupling socket for initial coupling and operation of said closure system, (c) a wide interlocking male member, situated on the other of said two elongated coupling elements, said wide interlocking male member being wider than said self-locking sliding zipper head, said wide male interlocking member is adapted for coupling and uncoupling said closure system, said wide male interlocking member being partially situated in a housing in an intergarment plate while coupled, said housing comprising means for use of a plurality of coupling methods for initially coupling said closure system, said wide male interlocking member provides the user more surface area for holding and easier guiding of said wide male interlocking member into a socket for initial coupling, and (d) said socket member (e) unlocking said self-locking sliding zipper head and drawing said self-locking sliding zipper head in a first direction along said one of said two elongated coupling elements to one end thereof, (f) providing an immobile and arrested initial coupling socket, (g) initially coupling said two elongated coupling elements, (h) unlocking and drawing said self-locking sliding zipper head in a second direction along said two elongated coupling elements closing said two elongated coupling elements along their length, (i) unlocking and drawing said self-locking sliding zipper head in said first direction along said two elongated coupling elements to said one end thereof, and (j) unlocking said closure system.

21. A method of providing an immobile and aligned closure system of claim 20, further including means for releasably installing said closure system.

22. A method of providing an immobile and aligned closure system of claim 20, further including a rigid, male and female snap-lock interlocking buckle, situated on the respective initiating ends of said two elongated coupling elements and said rows or chains of interengaging and locking members for instant initial coupling and uncoupling of said two elongated coupling elements for operation of said closure system, wherein said rigid, snap-lock buckle comprises softly coated touchable areas for the comfort of the user, wherein an interlocking site is adapted for placement anywhere on the male or female members.

23. A method of providing an immobile and aligned closure system of claim 20, further including a rigid, intergarment plate on one of said two elongated coupling elements for dependable initial coupling of said closure system, said intergarment plate being situated at the initiating end of said one of said two elongated coupling elements for operation of said closure system, said intergarment plate comprising a) a holder for holding a length of material, b) means for gripping said length of material for immobilizing and adjusting said material, c) means for releasing said closure system, d) housing for members comprising 1) a wide male interlocking member being wider than said self-locking sliding zipper head, and 2) a spring-lock assembly for operation of said closure system, said housing comprising means for use of a plurality of coupling methods for initially coupling said closure system.

* * * * *